US007672621B2

(12) United States Patent
Sato

(10) Patent No.: US 7,672,621 B2
(45) Date of Patent: Mar. 2, 2010

(54) DEVELOPING DEVICE AND TONER CARTRIDGE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 413 days.

(21) Appl. No.: 11/673,248

(22) Filed: Feb. 9, 2007

(65) Prior Publication Data

US 2007/0189811 A1 Aug. 16, 2007

(30) Foreign Application Priority Data

Feb. 13, 2006 (JP) ..... 2006-035443

(51) Int. Cl.
*G03G 15/08* (2006.01)

(52) U.S. Cl. ..... 399/258; 399/255; 399/256; 399/263

(58) Field of Classification Search ..... 399/254, 399/255, 256, 258, 260, 262, 263, 107, 111, 399/119, 120; 222/DIG. 1
See application file for complete search history.

(56) References Cited

U.S. PATENT DOCUMENTS

| | | | | |
|---|---|---|---|---|
| 5,659,859 | A * | 8/1997 | Kikuta et al. | 399/256 |
| 6,058,283 | A | 5/2000 | Okada | |
| 6,085,056 | A | 7/2000 | Okada | |
| 6,584,293 | B1 * | 6/2003 | Wang et al. | 399/258 |
| 2002/0012551 | A1 * | 1/2002 | Tsutsui et al. | 399/252 |
| 2003/0175051 | A1 * | 9/2003 | Sato et al. | 399/260 |
| 2005/0084300 | A1 | 4/2005 | Choi | |
| 2006/0008297 | A1 * | 1/2006 | Oyama et al. | 399/254 |

FOREIGN PATENT DOCUMENTS

| | | |
|---|---|---|
| JP | 7134483 | 5/1995 |
| JP | 8211720 | 8/1996 |
| JP | 9319202 | 12/1997 |
| JP | 10213957 | 8/1998 |

OTHER PUBLICATIONS

CN Office Action dtd Jul. 25, 2008, CN App. 2007100840470.

* cited by examiner

*Primary Examiner*—David P. Porta
*Assistant Examiner*—Benjamin Schmitt
(74) *Attorney, Agent, or Firm*—Banner & Witcoff, Ltd.

(57) ABSTRACT

A toner cartridge is to be attached to a developing device. The developing device is provided with a developing roller comprising a rotational axis extending along a horizontal direction, a first casing, and a first transporting member. The first casing includes a developing chamber for accommodating the toner to be supported by the developing roller, a first feed opening for feeding the toner from the toner cartridge to the developing chamber, and a first return opening for returning the toner from the developing chamber to the toner cartridge. The first transporting member is located within the developing chamber. The first transporting member transports the toner within the developing chamber from the first feed opening to the first return opening. The first feed opening and the first return opening are offset along the horizontal direction. The first feed opening is located higher the first return opening.

15 Claims, 12 Drawing Sheets

DEVELOPING DEVICE AND TONER CARTRIDGE

CROSS-REFERENCE TO RELATED APPLICATION

This application claims priority to Japanese Patent Application No. 2006-035443 filed on Feb. 13, 2006, the contents of which are hereby incorporated by reference into the present application.

BACKGROUND OF THE INVENTION

1. Field of the Invention

The present invention relates to technology for using toner to develop an electrostatic latent image formed on a photoreceptor. More particularly, the present invention relates to a toner cartridge that accommodates toners and a developing device to which this is to be attached.

2. Description of the Related Art

An image forming device (e.g., a laser printer) having a photoreceptor uses a developing device. A toner cartridge is attached to the developing device. A standard developing device comprises a casing, a supply roller, and a developing roller. The casing has a space for housing the toner cartridge, and a developing chamber that communicates with the space. The supply roller and the developing roller respectively have a rotational axis that extends along the horizontal direction. The supply roller is housed within the developing chamber. The supply roller supplies toners that were sent to the developing chamber to the developing roller. The developing roller supports the toners supplied by the supply roller.

The developing roller is in contact with the photoreceptor. An electrostatic latent image is formed on the surface of the photoreceptor. The developing roller supplies toners to the photoreceptor. The toners will adhere to the electrostatic latent image portion of the photoreceptor. In this way, the electrostatic latent image of the photoreceptor will be developed.

An example of a developing device is disclosed in Japanese Patent Application Publication No. 9-319202. In this technology, toners circulate between the developing device and the toner cartridge. Two side wall openings are formed in a side wall that defines the developing chamber of the developing device. The two side wall openings are offset along the horizontal direction, and are located at the same height. In addition, two case openings are formed in the toner cartridge. The two case openings are offset along the horizontal direction, and are located at the same height.

When the toner cartridge is attached to the developing device, one of the case openings and one of the side wall openings face each other, and the other case opening and the other side wall opening face each other. In this way, the toner cartridge and the developing chamber communicate with each other. The toners within the toner cartridge are sent to the developing chamber via one of the case openings and one of the side wall openings. An auger is provided in the developing device. The auger transports the toners within the developing chamber from one of the side wall openings to the other of the side wall openings. The toners within the developing chamber are returned to the toner cartridge via the other of the side wall openings and the other of the case openings.

BRIEF SUMMARY OF THE INVENTION

According to the above technology, toners are circulated between the developing device and the toner cartridge. By causing the toners to circulate, the stagnation and accumulation of poor quality toners occur inside the developing chamber can be prevented. In addition, fresh toners can be uniformly adhered across the entire supply roller.

When toners inside the developing chamber are not in a densely packed state, the toners will not adhere uniformly to the developing roller at a suitable thickness. This phenomenon can occur not only when the toners inside the developing chamber are directly supplied to the developing roller rather than not by the supply roller, but also when the toners inside the developing chamber are supplied to the developing roller via the supply roller. This is because there will be an effect on the developing roller, due to the fact that toners will not uniformly adhere to the supply roller.

In order to increase the density of the toners inside the developing chamber, toners must be sent from a high location into the developing chamber. In the aforementioned conventional technology, both side wall openings will be located at the same height. If both of the side wall openings are arranged in a high position, the density of the toners inside the developing chamber can be increased. However, in this configuration, the other side wall opening used to send toners from the developing chamber to de toner cartridge will also be located in a high position. When the other side wall opening is placed in a high position, it will become difficult for the toners to be returned from the developing chamber to the toner cartridge. However, if both side wall openings are arranged in a low position, the toners can be smoothly sent from the developing chamber to the toner cartridge, but the toners density inside the developing chamber will be reduced.

In the aforementioned conventional technology, the toners can neither be uniformly adhered to the developing roller at a suitable thickness, nor can it be smoothly circulated.

The present invention has taken the aforementioned facts into consideration, and provides technology that causes the toners to both uniformly adhere to the developing roller at a suitable thickness, and causes the toners to smoothly circulate.

This specification discloses a new developing device to which a toner cartridge is to be attached. This developing device comprises a developing roller, a first casing, and a first transporting member. The developing roller comprises a rotational axis extending along a horizontal direction. The developing roller is capable of supporting a toner. The first casing comprises a developing chamber for accommodating the toner to be supported by the developing roller, a first feed opening for feeding the toner from the toner cartridge to the developing chamber, and a first return opening for returning the toner from the developing chamber to the toner cartridge. The developing chamber is defined by the developing roller. The first transporting member is located within the developing chamber. The first transporting member transports the toner within the developing chamber from the first feed opening to the first return opening. The first feed opening and the first return opening are offset along the horizontal direction. The first feed opening is located higher than the first return opening.

"Extending along the horizontal direction", "offset along the horizontal direction", and "located higher" mean the state in which development is being performed by the developing device. When the developing device is not being used, the rotational axis of the developing roller need not necessarily extend along the horizontal direction. In addition, the first feed opening and the first return opening need not necessarily be offset along the horizontal direction, and the first feed opening need not necessarily be located higher than the first return opening.

The aforementioned developing device may not comprise a supply roller, and the toner within the developing chamber may be directly supplied to the developing roller. In addition, the developing device may comprise a supply roller. Here, the toner within the developing chamber will be supplied to the developing roller via the supply roller.

In addition, the aforementioned "developing chamber" means a chamber that is defined by the developing roller and/or the supply roller. For example, when there are two chambers in the casing that communicate with each other, the chamber defined by the developing roller and/or the supply roller is the developing chamber, and the other chamber cannot be said to be a developing chamber.

According to the aforementioned developing device, when the toner cartridge is attached to the developing device, the toner of the toner cartridge will be supplied to the developing chamber via the first feed opening. In addition, the toner of the developing chamber will be returned to the toner cartridge via the first return opening. The toner can be circulated between the toner cartridge and the developing device.

The first feed opening is located higher than the first return opening. Because the first feed opening is arranged higher, the toner can be sent into the developing chamber from a high position. The toner can be densely packed into the developing chamber. In addition, because the first return opening is located lower, the toner can return from a low location of the developing chamber to the toner cartridge. The circulation of the toner can be expedited.

When this developing device is used, the toner can be both uniformly adhered to the developing roller at a suitable thickness, and can be smoothly circulated.

In the present specification, a toner cartridge is also provided. This toner cartridge comprises a second casing and a second transporting member. The second casing comprises a toner chamber for accommodating a toner, a second feed opening for feeding a toner from the toner chamber to the outside of the second casing, and a second return opening for returning the toner from the outside of the second casing to the toner chamber. The second transporting member transports the toner within the toner chamber from the second return opening to the second feed opening. The second feed opening and the second return opening are offset along a horizontal direction. The second feed opening is located higher than the second return opening.

"Offset along the horizontal direction" and "located higher" mean the state in which the toner cartridge is attached to the developing device and development is being performed.

If this toner cartridge is adopted, the toner can circulate between the toner cartridge and the developing device. Because the second feed opening is located higher than the second return opening, the toner can be sent into the developing chamber of the developing device from a high position. In addition, the toner can return to the toner cartridge from a low position of the developing chamber of the developing device.

In the present specification, the following developing device is also provided. This developing device comprises a third casing, a developing roller, a third transporting member, and a forth transporting member. The third casing comprises a toner chamber, a developing chamber, a feed port for feeding a toner from the toner chamber to the developing chamber, and a return port for returning the toner from the developing chamber to the toner chamber. The developing roller comprises a rotational axis extending along a horizontal direction. The developing roller is capable of supporting the toner within the developing chamber. The third transporting member is located within the developing chamber. The third transporting member transports the toner within the developing chamber from the feed port to the return port. The forth transporting member transports the toner within the toner chamber from the return port to the feed port. The feed port and the return port are offset along the horizontal diction. The feed port is located higher than the return port.

The toner chamber may be detachable from portions other than the toner chamber. Because the feed port is arranged higher, the toner can be sent into the developing chamber from a high position. The toner can be densely packed into the developing chamber. In addition, because the return port is located lower, the toner can be sent from a low position of the developing chamber to the toner chamber. The circulation of the toner can be expedited.

When this developing device is used, the toner can be both uniformly adhered to the developing roller at a suitable thickness, and can be smoothly circulated.

BRIEF DESCRIPTION OF THE DRAWINGS

In FIG. 13, the lever member is lowered from the state of FIG. 12.

DETAILED DESCRIPTION OF THE INVENTION

Prior to describing the embodiments of the present invention, some of the features of the technology disclosed in the embodiments will be listed below.

(Feature 1) The first transporting member faces the side wall in which the side wall feed opening (corresponding to the aforementioned first feed opening) and the side wall return opening (corresponding to the aforementioned first return opening) are formed. The supply roller also faces the side wall. The developing roller is in contact with the supply roller.

(Feature 2) The first transporting member is a single auger. The toner does not move back and forth inside the developing device.

(Feature 3) The developing chamber is defined by the developing roller. The developing chamber is defined by a thickness regulating member that contacts the developing roller. The developing chamber is defined by a seal member that contacts the lower surface of the developing roller.

(Feature 4) The toner cartridge has a cylindrical member that is housed in the interior of the case main body. The cylindrical member has a cylindrical member feed opening and a cylindrical member return opening. The cylindrical member rotates with respect to the case main body. A case feed opening will be opened when facing the cylindrical member feed opening. The case return opening will be opened when facing the cylindrical member return opening. When the cylindrical member rotates with respect to the case main body, the case feed opening and the case return opening open and close.

(Feature 5) The second transporting member is an agitator. The agitator has a portion that transports toner from the case return opening to the case feed opening, and a portion that pushes toner around the periphery of the case feed opening into the case feed opening.

First Embodiment

Figure 1:
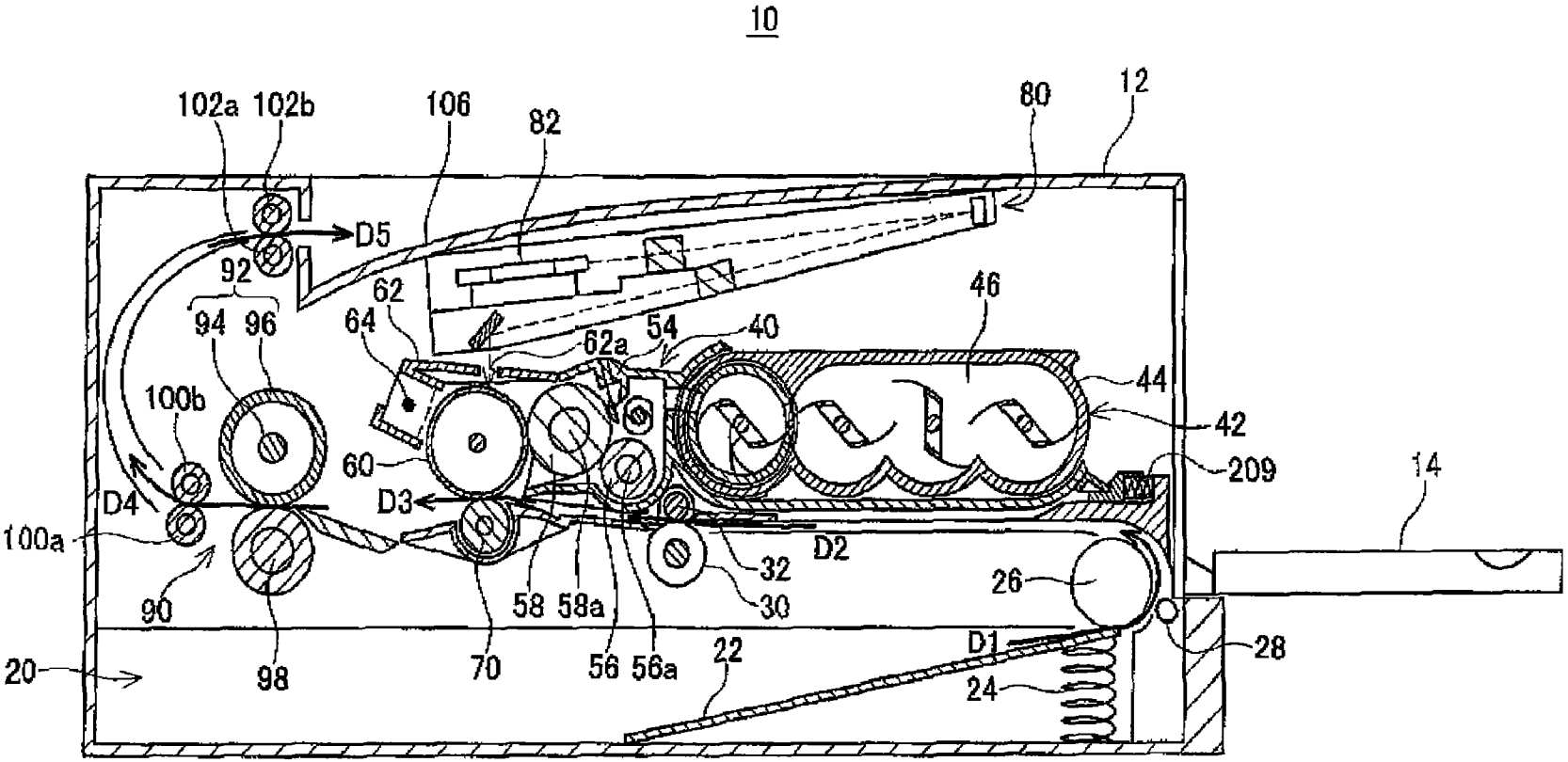
FIG. 1 shows the overall vertical cross-section of a first embodiment of a laser printer.

An embodiment of the present invention will be described with reference to the drawings. FIG. 1 is an overall vertical cross-section of a laser printer 10 of the present embodiment. The laser printer 10 will be hereinafter simply referred to as the "printer 10".

(Overall Construction of the Laser Printer)

First, the overall construction of the laser printer 10 will be briefly explained.

(Construction of the Casing)

The printer 10 has a casing 12. The casing 12 comprises a plurality of plate-shaped members. The casing 12 has a door 14. In FIG. 1, the door 14 is shown in the open state. In this state, a toner cartridge 42 described below can be replaced. When the door 14 is pivoted in the counterclockwise direction from the state shown in FIG. 1, the casing 12 will be closed.

The printer 10 has a paper supply device 20, a developing device 40, a photoreceptor 60, a transferring device 70, an exposure device 80, a toner fixing device 90, and the like. The devices 20, 40, 60, 70, 80, 90 are located in the interior of the casing 12. Each device 20, 40, 60, 70, 80, 90 will be explained in sequence below.

(Construction of the Paper Supply Device)

The paper supply device 20 comprises a bottom plate 22, a spring 24, two rollers 26, 28, and the like. A plurality of print media not shown in the drawings is loaded onto the bottom plate 22. The spring 24 pushes the right end of the bottom plate 22 upward. In this way, the print media put on the bottom plate 22 will contact with the roller 26. The roller 26 will rotate in the counterclockwise direction. When the roller 26 rotates, the uppermost print medium put on the bottom plate 22 will be sent along the direction of the arrow D1. The roller 28 will be driven in the clockwise direction when the roller 26 rotates. The print medium sent along the direction of the arrow D1 by the rollers 26, 28 will pass between rollers 30, 32 (arrow D2).

Text or an image will be printed on the print medium sent along the direction of arrow D2. More specifically, printing will be performed by means of the developing device 40, the photoreceptor 60, the transferring device 70, the exposure device 80, and the fixing device 90.

(Construction of the Developing Device and the Toner Cartridge)

The toner cartridge 42 can be detached from the developing device 40. The toner cartridge 42 has a case main body 44. The case main body 44 has a chamber 46 that accommodates toner. The toner cartridge 42 is detachably attached to the developing device 40. When the cover member 14 is opened, the toner cartridge 42 can be removed from the developing device 40. In addition, in this state, a new toner cartridge can be attached to the developing device 40.

Note that a press lock mechanism 209 is provided inside the casing 12. The press lock mechanism 209 pushes the toner cartridge 42 in the leftward direction.

The developing device 40 is detachably attached to the casing 12. When the cover member 14 is opened, the developing device 40 can be removed from the casing 12.

The developing device 40 has a case 54, a supply roller 56, a developing roller 58, and the like. The supply roller 56 and the developing roller 58 are housed inside the case 54. The supply roller 56 has a rotational shaft 56*a* that extends in a direction that is perpendicular to the plane of FIG. 1. The rotational shaft 56*a* is rotatably supported by the case 54. The supply roller 56 will rotate in the counterclockwise direction. The developing roller 58 has a rotational shaft 58*a* that extends in a direction that is perpendicular to the plane of FIG. 1. The rotational shaft 58*a* is rotatably supported by the case 54. The developing roller 58 is in contact with the supply roller 56 on the left side of the supply roller 56. The developing roller 58 will rotate in the counterclockwise direction.

The toner of the toner cartridge 42 will be sent to the developing device 40. The supply roller 56 supports toner that was sent from the toner cartridge 42. By rotating the supply roller 56 and the developing roller 58 while in contact with each other, toner will be supplied from the supply roller 56 to the developing roller 58. At this point, the toner will have a positive electrostatic charge due to the friction between the supply roller 56 and the developing roller 58. The developing roller 58 supports toner having a positive electrostatic charge.

Details on the construction of the developing device 40 and the toner cartridge 42 will be described below.

(Construction of the Photoreceptor and around the Periphery hereof)

The photoreceptor 60 is housed inside a frame 62. The case 54 of the developing device 40 and the frame 62 are constructed separately. The developing device 40 is detachably attached to the frame 62.

The photoreceptor 60 is in contact with the developing roller 58 on the left side of the developing roller 58. The photoreceptor 60 will rotate in the clockwise direction. The frame 62 has a through hole 62*a*. Laser light is irradiated from the exposure device 80, and passes through the through hole 62*a* and arrives at the photoreceptor 60.

A scorotron electrostatic charger 64 is located to the left of the photoreceptor 60. The scorotron electrostatic charger 64 provides a positive electrostatic charge on the surface of the photoreceptor 60 by means of a corona discharge.

The surface of the photoreceptor 60 on which a positive electrostatic charge is provided will be exposed by the laser light generated from the exposure device 80. In this way, predetermined portions of the surface of the photoreceptor 60 will be exposed. The portions to be exposed will change based on the content to be printed. The electric potential of the exposed portions of the photoreceptor 60 will fall. In this way, an electrostatic latent image based on the content to be printed will be formed on the photoreceptor 60.

By rotating the developing roller 58 and the photoreceptor 60 while in contact with each other, the toner supported on the developing roller 58 will adhere to the exposed portions of the photoreceptor 60. Toner will not adhere to the non-exposed portions of the photoreceptor 60. In this way, an electrostatic latent image formed on the photoreceptor 60 will be made visible. In other words, the photoreceptor 60 will be developed by the developing device 40.

(Construction of the Transferring Device)

The transferring device 70 is in contact with the lower surface of the photoreceptor 60. The transferring device 70 is constructed with a transfer roller composed of an elastic material having conductivity. The transferring device 70 will rotate in the counterclockwise direction. The transferring device 70 is connected to a voltage supply circuit not shown in the drawings. A bias will be applied to the transferring device 70 from the voltage supply circuit during transfer (when the toner adhered to the photoreceptor 60 is transferred to the print medium).

The printing medium sent along the direction of the arrow D2 will pass between the photoreceptor 60 and the transferring device 70 (arrow D3). At this point, the bias will be applied to the transferring device 70. The toner will be transferred to the print medium from the photoreceptor 60 due to the difference in electric potential between the photoreceptor 60 and the transferring device 70.

(Construction of the Exposure Device)

The exposure device 80 is located above the developing device 40. The exposure device 40 is fixed to the casing 12. The exposure device 80 has a light source not shown in the drawings. The light source generates laser light. The laser light generated is deflected with a polygon mirror 82. The laser light deflected with the polygon mirror 82 proceeds along the direction of the broken arrow line of FIG. 1. The laser light will pass through the through hole 62*a* described above and arrive at the photoreceptor 60. In this way, the photoreceptor 60 will be exposed.

(Construction of the Toner Fixing Device)

The toner fixing device 90 is located to the left of the photoreceptor 60 and the transferring device 70. The toner fixing device 90 has a heat roller 92, a pressure roller 98, and the like. The heat roller 92 has a halogen lamp 94 and a metal tube 96. The halogen lamp 94 will heat the metal tube 96. The heat roller 92 will rotate in the clockwise direction. The pressure roller 98 will be pushed toward the heat roller 92 by means of a mechanism not shown in the drawings. The pressure roller 98 will be driven and rotated in the counterclockwise direction when the heat roller 92 rotates in the clockwise direction.

Print media that passes between the photoreceptor 60 and the transferring device 70 will be interposed between the heat roller 92 and the pressure roller 98. At this point, the heat roller 92 will heat the print media. In this way, the toner transferred to the print media will be fixed by means of heat. The print media that has passed through the toner fixing device 90 will be sent upward and leftward by rollers 100*a*, 100*b*.

(Construction of the Paper Discharge Mechanism)

A pair of rollers 102*a*, 102*b* is located above the toner fixing device 90. The print media sent in the direction of the arrow D4 will be interposed between the pair of rollers 102*a*, 102*b*. The print media will be sent rightward by a pair of rollers 102*a*, 102*b* (arrow D5). The print media will be sent to the exterior of the casing 12. A paper discharge tray 106 is formed on the upper surface of the casing 12. The print media sent to the exterior of the casing 12 will be discharged on the paper discharge tray 106.

The overall construction of the printer 10 was simply described. In addition, the process of printing on print media by means of the printer 10 was simplified. Next, the construction of the developing device 40 and the toner cartridge 42 will be described in detail.

(Detailed Construction of the Developing Device and the Toner Cartridge)

Figure 2:
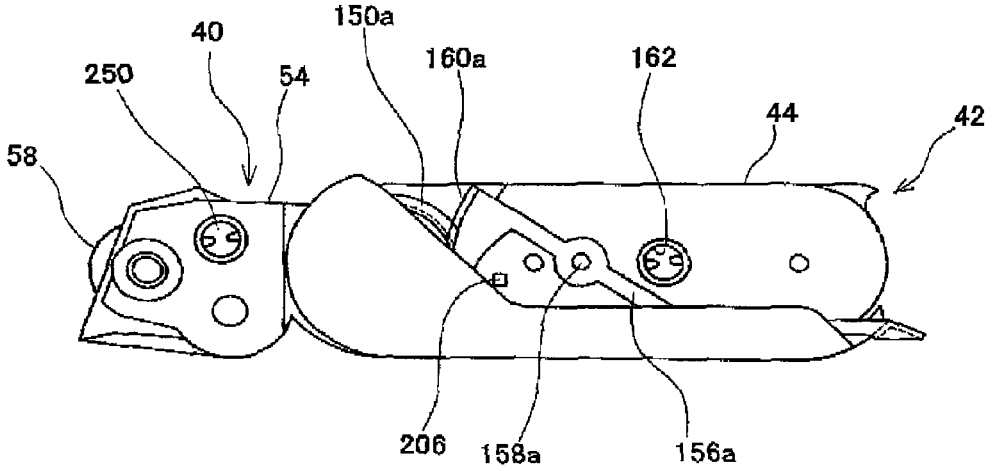
FIG. 2 shows a developing device and a toner cartridge when viewed along the direction perpendicular to the plane of FIG. 1.

FIG. 2 shows the developing device 40 and the toner cartridge 42 when viewed along the direction perpendicular to the plane of FIG. 1. In the state shown in FIG. 2, the toner cartridge 42 is attached to the developing device 40.

(Construction of the Toner Cartridge)

Figure 3:
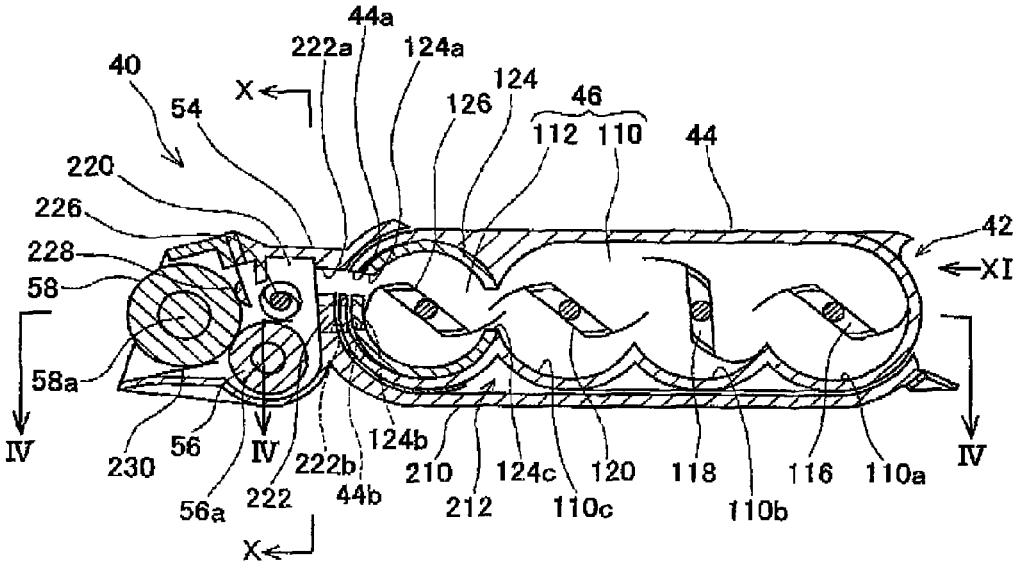
FIG. 3 shows a vertical cross-section of the developing device and the toner cartridge.

FIG. 3 shows a vertical cross-section of the developing device 40 and the toner cartridge 42. First, the construction of the toner ridge 42 will be described with reference to FIG. 3.

The toner cartridge 42 has a case main body 44, agitators 116, 118, 120, 126, a cylindrical member 124, and the like.

(Construction Inside the Case Main Body)

The case main body 44 has a substantially rectangular parallelepipedic shape that extends along the horizontal direction (the direction perpendicular to the plane of FIG. 3 and in the horizontal direction). In other words, the case main body 44 has a flat shape.

The case main body 44 has a chamber 46 that accommodates toner. The chamber 46 stores a non-magnetic one component type toner having a positive electrostatic charge. For example, a polymer toner will be used that was obtained by co-polymerizing a styrene monomer or an acrylic monomer by means of suspension polymerization. Acrylic monomers may include acrylic acid, acryl (C1-C4) acrylate, alkyl (C1-C4) methacrylate, and the like. This polymer toner has a substantially spherical shape and has superior fluidity. A colorant and a wax are combined with the polymer toner. In addition, additives such as silica and the like are added in order to improve fluidity.

The chamber 46 is divided into a chamber 110 on the right side of FIG. 3 and a chamber 112 on the left side of FIG. 3. In the state shown in FIG. 3, the chamber 110 and the chamber 112 communicate by means of an opening 124*c*.

The bottom surface of the chamber 110 has three curved surfaces 110*a*, 110*b*, and 110*c*. Three agitators 116, 118, 120 are housed in the chamber 110. The agitator 116 is located above the curved surface 110*a*. The agitator 118 is located above the curved surface 110*b*. The agitator 120 is located above the curved surface 110*c*. Each agitator 116, 118, 120 rotates in the clockwise direction. In this way, the toner inside the chamber 110 will be sent in the direction of the chamber 112.

An agitator 126 is located inside the chamber 112 (the cylindrical member 124). The agitator 126 will rotate in the clockwise direction. The construction of the agitator 126 will be described in detail below.

The cylindrical member 124 is housed in the interior of the case main body 44. The cylindrical member 124 can rotate in the clockwise or counterclockwise direction with respect to the case main body 44. The chamber 112 is defined by the cylindrical member 124.

The cylindrical member 124 has three openings 124*a*, 124*b*, and 124*c*. The cylindrical member feed opening 124*a* and the cylindrical member return opening 124*b* are offset in the direction perpendicular to the plane of FIG. 3. The cylindrical member feed opening 124*a* is located on the near side in the direction perpendicular to the plane of FIG. 3, and the cylindrical member return opening 124*b* is located on the far side in the direction perpendicular to the plane of FIG. 3. In the state shown in FIG. 3, the cylindrical member feed opening 124*a* is located higher than the cylindrical member return opening 124*b*. Toner to be sent to the developing device 40 from the chamber 112 will pass through the cylindrical member feed opening 124*a*. Toner to be returned from the developing device 40 to the chamber 112 will pass through the cylindrical member return opening 124*b*.

The other cylindrical member opening 124*c* serves to allow the chamber 110 and the chamber 112 to communicate with each other. The toner of the chamber 110 will move to the chamber 112 through the cylindrical member opening 124*c*.

The case main body 44 has two openings 44*a*, 44*b*. The case feed opening 44*a* and the case return opening 44*b* are offset in the direction perpendicular to the plane of FIG. 3. The case feed opening 44*a* is located on the near side in the direction perpendicular to the plane of FIG. 3, and the case return opening 44*b* is located on the far side in the direction perpendicular to the plane of FIG. 3. The case feed opening 44*a* is located higher than the case return opening 44*b*. In the state shown in FIG. 3, the case feed opening 44*a* faces the cylindrical member feed opening 124*a*. In addition, the case return opening 44*b* faces the cylindrical member return opening 124*b*. Toner to be sent to the developing device 40 from the chamber 112 will pass through the case feed opening 44*a*. Toner to be returned from the developing device 40 to the chamber 112 will pass through the case return opening 44*b*.

(Construction of the Agitator Drive Mechanism)

Figure 4:
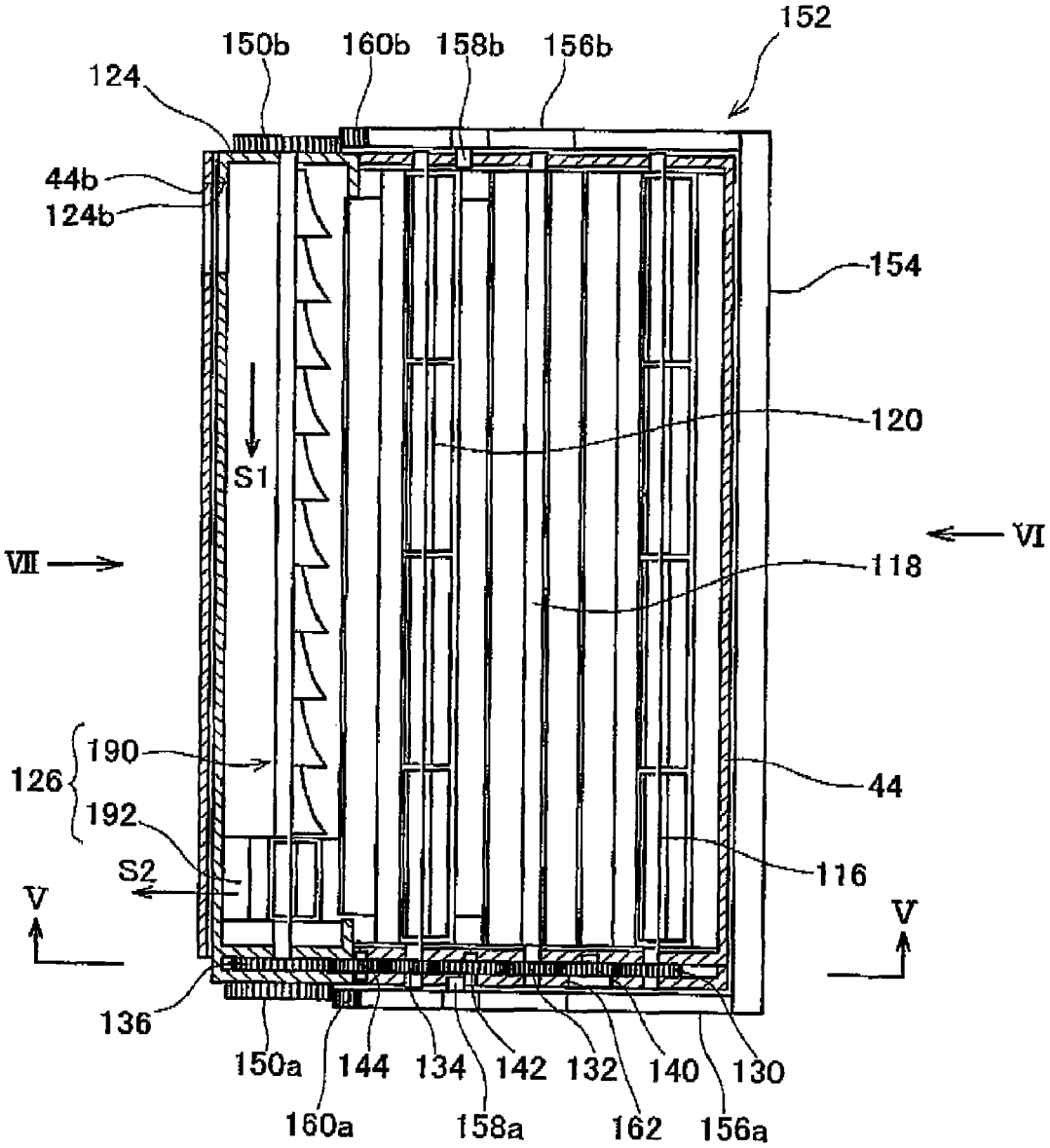
FIG. 4 shows a cross-section along line IV-IV of FIG. 3.

FIG. 4 shows a cross-section along line IV-IV of FIG. 3. A mechanism for rotating each agitator 116, 118, 120, 126 will be described with reference to FIG. 4.

The three agitators 116, 118, 120 on the right side are respectively rotatably supported on the case main body 44. The lower end of the agitator 116 (the lower end of FIG. 4) is connected to a gear 130. Likewise, the lower end of the agitator 118 is connected to a gear 132. The lower end of the agitator 120 is connected to a gear 134. Each gear 130, 132, 134 is rotatably supported by the case main body 44.

The leftmost agitator 126 is rotatably supported by the cylindrical member 124. The lower end of the agitator 126 is connected to a gear 136. The gear 136 is not fixed to the cylindrical member 124, and rotates with respect to the cylindrical member 124.

An intermediate gear 140 is interposed between the gear 130 and the gear 132. An intermediate gear 142 is interposed between the gear 132 and the gear 134. An intermediate gear 144 is interposed between the gear 134 and the gear 136. Each intermediate gear 140, 142, 144 is rotatably supported by the case main body 44.

A drive shaft 162 is connected to the intermediate gear 140. The drive shaft 162 is exposed on a side surface of the case main body 44. This is shown well in FIG. 2. The printer 10 has a drive source (not shown in the drawings) that rotates the drive shaft 162.

Figure 5:
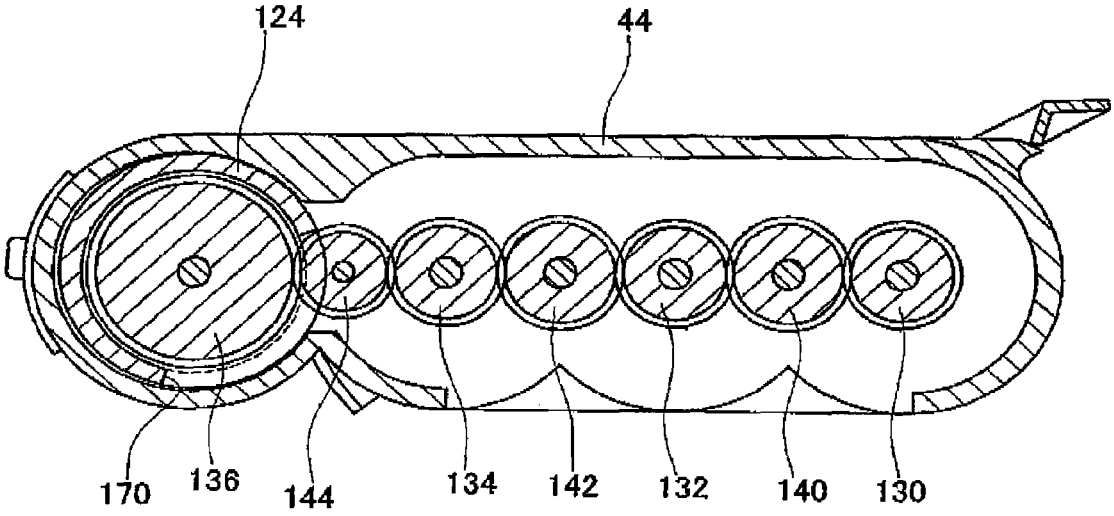
FIG. 5 shows a cross-section along line V-V of FIG. 4.

FIG. 5 shows a cross-section taken along line V-V of FIG. 4. Each gear 130, 132, 134, 136 meshes with each intermediate gear 140, 142, 144.

When a drive force is input to the drive shaft 162 (see FIG. 4 and others), the intermediate gear 140 will rotate in the counterclockwise direction. When the intermediate gear 140 rotates in the counterclockwise direction, the gears 130, 132 will rotate in the clockwise direction. In this way, the agitator 116, 118 will rotate in the clockwise direction of FIG. 3. When the gear 132 rotates in the clockwise direction, the intermediate gear 142 will rotate in the counterclockwise direction. When the intermediate gear 142 rotates in the counterclockwise direction, the gear 134 will rotate in the clockwise direction. In this way, the agitator 120 will rotate in the clockwise direction of FIG. 3. When the gear 134 rotates in the clockwise direction, the intermediate gear 144 will rotate in the counterclockwise direction. When the intermediate gear 144 rotates in the counterclockwise direction, the gear 136 will rotate in the clockwise direction. In this way, the agitator 126 will rotate in the clockwise direction of FIG. 3.

Note that as shown in FIG. 5, the cylindrical member 124 has a cutout 170. Because the cutout 170 is formed, the cylindrical member 124 will not interfere with the gear 136 and the intermediate gear 144. The cylindrical member 124 can rotate from the state shown in FIG. 5 approximately 90 degrees in the counterclockwise direction. The cutout 170 is formed across an angle of 90 degrees or greater. Because of this, the cylindrical member 124 will not interfere with the gear 136 and the intermediate gear 144, even if rotated in the counterclockwise direction.

(Construction of the Cylindrical Member Drive Mechanism)

Next, a mechanism for rotating the cylindrical member 124 with respect to the case main body 44 will be described.

As shown in FIG. 4, a lever member 152 is provided on the outer periphery of the case main body 44. The lever member 152 has a portion 154 that extends in the up-and-down direction (the up-and-down of FIG. 4) along the rear surface of the case main body 44 (the right surface of FIG. 4), a portion 156*a* that extends in the right-and-left direction (the right-and-left of FIG. 4) along one side surface of the case main body 44 (the lower surface of FIG. 4), and a portion 156*b* that extends in the right-and-left direction along the other side surface of the case main body 44 (the upper surface of FIG. 4). The shape of the portion 156*a* can be understood by viewing FIG. 2. In addition, the shape of the portion 156*a* is shown in greater detail in FIGS. 12 and 13 described below. The upper end of the portion 154 (the upper end of FIG. 4) is fixed on the right end of the portion 156*b*. The lower end of the portion 154 is fixed to the right end of the portion 156*a*.

Figure 6:
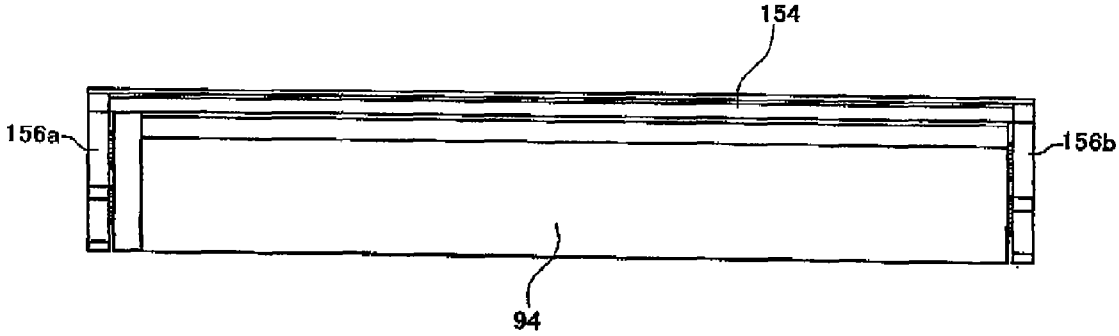
FIG. 6 shows the toner cartridge when viewed along the IV direction of FIG. 4.

FIG. 6 shows the case main body 44 when viewed along the VI direction of FIG. 5. As is clear when viewing FIG. 6*d* the portion 154 is a rod shaped member.

As shown in FIG. 4, the portion 156*a* has a pivot shaft 158*a*. The pivot shaft 158*a* is pivotably supported by the case main body 44. The pivot shaft 158*a* is also illustrated in FIG. 2. In addition, the portion 156*b* also has a pivot shaft 158*b*. The pivot shaft 158*b* is pivotably supported by the case main body 44.

As shown in FIG. 4, a gear 160*a* is formed on the left end of the portion 156*a*. The gear 160 is also shown in FIG. 2. In addition, a gear 160*b* is also formed on the left end of the portion 156*b*.

A pair of gears 150*a*, 150*b* is formed on the cylindrical member 124. One gear 150*a* is fixed to the side surface on the lower side (the lower side of FIG. 4) of the cylindrical member 124. The gear 150*a* meshes with the gear 160*a* of the portion 156*a* of the lever member 152. The other gear 150*b* is fixed to the side surface on the upper side of the cylindrical member 124. The gear 150*b* meshes with the gear 160*b* of the portion 15*b* of the lever member 152.

When a force is applied to the portion 154 of the lever member 152 in the direction perpendicular to the plane of FIG. 4, the lever member 152 will pivot with the pivot shafts 158*a*, 158*b* as a fulcrum. When the lever member 152 pivots, the gears 150*a*, 150*b* that are meshed with the gears 160*a*, 160*b* will rotate. In this way, the cylindrical member 124 will rotate. This will be explained again below by using FIGS. 12 and 13.

(Construction of the Front Periphery of the Case Main Body)

Figure 7:
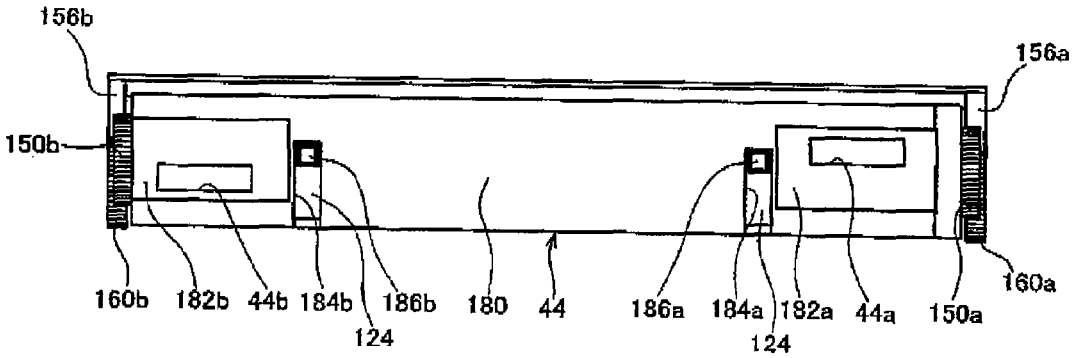
FIG. 7 shows a toner cartridge when viewed along the VII direction of FIG. 4.

Next, the construction of the front of the case main body (the left surface of FIG. 4) will be described. FIG. 7 shows the case main body 44 when viewed along the VII direction of FIG. 4.

The front surface 180 of the case main body 44 has the case feed opening 44*a* and the case return opening 44*b*. The case feed opening 44*a* is located adjacent to the right end of the front surface 180. The case return opening 44*b* is located adjacent to the left end of the front surface 180. The case feed opening 44*a* is located higher than the case return opening 44*b*. The two case openings 44*a*, 44*b* have the same shape (a rectangular shape that extends in the horizontal direction).

A pair of sponges 182*a*, 182*b* is adhered to the front surface 180. The pair of sponges 182*a* are located around the periphery of the case feed opening 44*a*. The sponge 182*a* has an opening 278*a* of the same shape as the case feed opening 44*a* (reference number omitted in FIG. 7 but shown in FIG. 13). The opening 278*a* of the sponge 182*a* faces the case feed opening 44*a*. Because of this, toner inside the case main body 44 will pass through both the case feed opening 44*a* and the opening 278*a* in the sponge 182*a*, and will be sent to the outside of the case main body 44 (to the developing device 40).

The other sponge 182*b* is located around the periphery of the case return opening 44*b*. Like with the sponge 182*a*, the sponge 182*b* is formed with an opening 278*b* (shown in FIG. 13) of the same size as the case return opening 44*b*. The opening 278*b* of the sponge 182*b* faces the case return opening 44*b*. The toner inside the developing device 40 passes through both the opening 278*b* in the sponge 182*b* and the case return opening 44*b*, and returns to the case main body 44.

A pair of guide openings 184*a*, 184*b* is formed in the front surface of the case main body 44. The guide openings 184*a*, 184*b* pass through the front surface 180 of the case main body 44. Because of this, in FIG. 7, the cylindrical member 124 is visible in the rear of the guide openings 184*a*, 184*b*.

A pair of projections 186*a*, 186*b* is formed on the cylindrical member 124. The projection 186*a* extends out of the guide opening 184*a*, and outward perpendicular to the plane of FIG. 7. The projection 186*b* extends out of the guide opening 184*b*, and outward perpendicular to the plane of FIG. 7. When the cylindrical member 124 rotates with respect to the case main body 44, each projection 186*a*, 186*b* will be guided along each guide opening 184*a*, 184*b*.

(Construction of the Agitator)

Next, the construction of the agitator 126 (see FIG. 4) will be described. The other three agitators 116, 118, 120 have constructions that send toner along the horizontal direction (from the left to the right) of FIG. 4. This construction is well known, and a detailed description thereof will be omitted. The agitator 126 has a construction different from the other agitators 116 etc.

Figure 8:
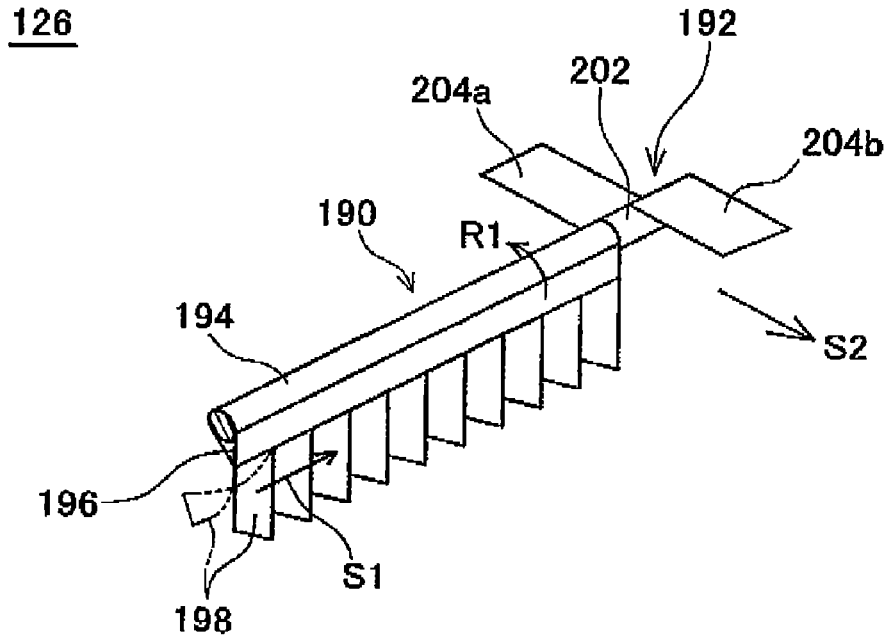
FIG. 8 shows an oblique view of an agitator.

FIG. 8 shows an oblique view of the agitator 126. The agitator 126 has a rotational shaft 194. The agitator 126 can be divided into a portion 190 for transporting toner along the rotational shaft 194 (referred to as the transport portion 190), and a portion 192 that sends out toner along a direction perpendicular to the rotational shaft 194 (referred to as the dispatch portion 192). The sport portion 190 has a triangular rod portion 196 and a plurality of films 198. In FIG. 8, only one of the films 198 has a reference number associated therewith. The triangular rod portion 196 is integrally formed with the rotational shaft 194. Each film 198 is adhered to the triangular rod portion 196.

Figure 9:
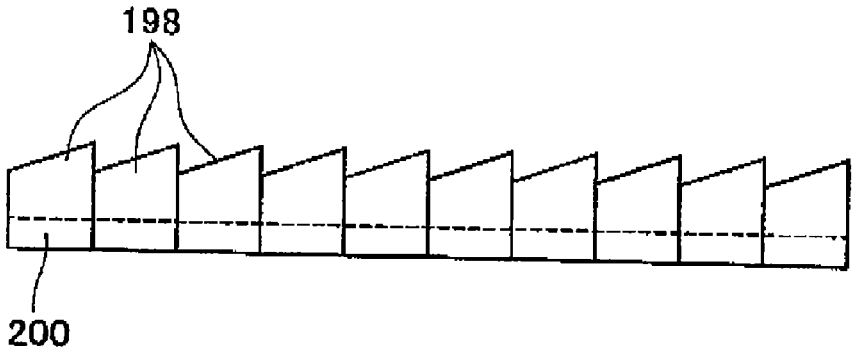
FIG. 9 shows a plan view of the film of the agitator.

FIG. 9 shows a plan view of the plurality of films 198. Each film 198 has a trapezoidal shape. Each film 198 is constructed such that the long end thereof is located on the dispatch portion 192 side. The length of each film 198 in the vertical direction of FIG. 9 is longer than the radius of the cylindrical member 124 (see FIGS. 3 and 4). Thus, each film 198 is in contact with the inner surface of the cylindrical member 124. Each film 198 is adhered to the triangular rod portion 196 by means of two-sided tape 200.

The dispatch portion 192 of FIG. 8 has a plate shaped member 202 and films 204*a*, 204*b*. The plate shaped member 202 is fixed to the rotational shaft 194. Although not visible in FIG. 8, the rotational shaft 194 extends upward and to the right in FIG. 8 beyond the plate shaped member 202.

The film 204*a* is adhered to one end of the plate shaped member 202. The film 204*b* is adhered to the other end of the plate shaped member 202. The films 204*a*, 204*b* are different from the films 198, and are formed in a substantially rectangular shape. The films 204*a*, 204*b* are in contact with the inner surface of the cylindrical member 124.

The rotational shaft 194 will rotate along the direction of the arrow R1 in FIG. 8 (the clockwise direction of FIG. 3). At this point, each film 198 of the sport portion 190 will rotate while twisting as shown by the dashed line of FIG. 8. The toner will be sent in the direction of the arrow S1 by rotating each film 198 while twisting. In other words, as shown in FIG. 4, the toner will be transported from the case return opening 44*b* (the cylindrical member return opening 124*b*) along the direction (direction S1 of FIG. 4) of the case feed opening 44*a* (the cylindrical member feed opening 124*a*) not visible in FIG. 4.

When the rotational shaft 194 rotates, the films 204*a*, 204*b* of the dispatch portion 192 also rotate. The film 204*a*, 204*b* rotate while flexing along the rotational direction because they are in contact with the inner surface of the cylindrical member 124. However, the films 204*a*, 204*b* will not twist like the films 198. The toner will be sent in the direction of the arrow S2 by rotating the films 204*a*, 204*b*. In other words, the dispatch portion 192 will push the toner out of the case feed opening 44*a* (the cylindrical member feed opening 124*a*; see FIG. 3 etc.).

(Construction of the Developing Device)

The construction of the toner cartridge 42 was described in detail. Next, returning to FIG. 3, the construction of the developing device 40 will be described. The developing device 40 has the case 54, the supply roller 56, the developing roller 58, an auger 226, and the like.

(Construction of the Case)

The case 54 has a developing chamber 220. The right side surface in FIG. 3 of the developing chamber 220 is defined by a side wall 222. In addition, the left side surface of the developing chamber 220 is defined by the developing roller 58, a thickness regulating member 228, and a seal member 230. The thickness regulating member 228 is in contact with the developing roller 58. The thickness regulating member 228 regulates (adjusts) the thickness of the toner layer on the developing roller 58. The seal member 230 seals between the lower surface of the developing roller 58 and the case 54.

A side wall feed opening 222*a* and a side wall return opening 222*b* are formed in the side wall 222. The side wall feed opening 222*a* faces the case feed opening 44*a* of the case main body 44. The side wall return opening 222*b* faces the case return opening 44*b* of the case main body 44. The side wall feed opening 222*a* and the side wall return opening 222*b* are offset in the direction perpendicular to the plane of FIG. 3. The side wall feed opening 222*a* is located on the near side in the direction perpendicular to the plane of FIG. 3, and the side wall return opening 222*b* is located on the far side in the direction perpendicular to the plane of FIG. 3. The side wall feed opening 222*a* is located higher than the side wall return opening 222*b*.

Toner to be sent to the developing chamber 220 from the toner cartridge 42 will pass through the side wall feed opening 222*a*. Toner to be returned to the toner cartridge 42 from the developing chamber 220 will pass through the side wall return opening 222*b*.

The case 54 has a bottom plate 210 that extends rightward from the lower end of the side wall 222. A space 212 above the bottom plate 210 is a space for housing the toner cartridge 42. The space 212 and the developing chamber 220 communicate with each other when the toner cartridge 42 is attached. In addition, when the toner cartridge 42 is not attached, the side wall feed opening 222*a* and the side wall return opening 22*b* are closed by a shutter 262 described below (see FIG. 11), and the space 212 and the developing chamber 220 will not communicate with each other.

The toner cartridge 42 is mounted on top of the bottom plate 210. In this way, the toner cartridge 42 is attached to the developing device 40.

(Construction of the Supply Roller)

The supply roller 56 is housed inside the developing chamber 220 so as to face the side wall 222. The upper end of the supply roller 56 is located between the upper end and the lower end of the side wall return opening 222*b*. The rotational shaft 56*a* of the supply roller 56 is rotatably supported by the case 54.

Figure 10:
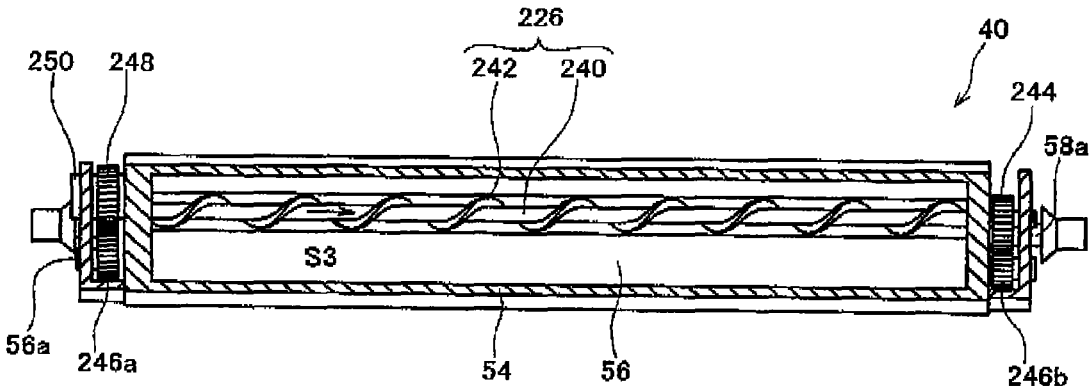
FIG. 10 shows a cross-section along line X-X of FIG. 3.

FIG. 10 shows a cross-section along line X-X of FIG. 3. A gear 246*a* is connected to the left end portion of the rotational shaft 56*a* of the supply roller 56. A gear 246*b* is connected to the right end portion of the rotational shaft 56*a*.

(Construction of the Developing Roller)

As shown in FIG. 3, the developing roller 58 is in contact with the supply roller 56. The developing roller 58 is exposed to the exterior from the left side surface of the case 54. The developing roller 58 can also be said to face the side wall 222.

As shown in FIG. 10, the rotational shaft 58*a* of the developing roller 58 is rotatably supported by the case 54. A gear (not shown in the drawings) is connected to the left end portion of the rotational shaft 58*a*.

(Construction of the Auger)

As shown in FIG. 3, the auger 226 is housed inside the developing chamber 220 so as to face the side wall 222. The auger 226 is located above the supply roller 56. The auger 226 faces both the side wall feed opening 222*a* and the side wall return opening 222*b*. The auger 226 is located between the side wall feed opening 222*a* and the side wall return opening 222*b* in the vertical direction of FIG. 3 (the height direction). In other words, the auger 226 is located lower than the side wall feed opening 222*a*, and higher than the side wall return opening 222*b*.

The shape of the auger 226 can be better understood by viewing FIG. 10. The auger 226 has a rotational shaft 240 and a spiral member 242. The rotational shaft 240 extends in the horizontal direction of FIG. 10 (perpendicular to the plane of FIG. 3). The rotational shaft 240 is rotatably supported by the case 54. The spiral member 242 is formed along the rotational shaft 240. The auger 226 will rotate in the clockwise direction of FIG. 3.

As shown in FIG. 10, a gear 244 is connected to the right end portion of the rotational shaft 240 of the auger 226.

(Construction of the Drive Mechanism for Each Roller and Auger)

As shown in FIG. 2, a drive shaft 250 is exposed on the side surface of the case 54. A drive source not shown in the drawings will output a rotational force to the drive shaft 250. The drive shaft 250 is connected to a drive gear 248 shown in FIG. 10. The drive gear 248 meshes with the gear 246*a* of the supply roller 56. In addition, the drive gear 248 meshes with a gear (not shown in the drawings) of the developing roller 58.

On the other hand, the other gear 246*b* of the supply roller 56 meshes with the gear 244 of the auger 226.

When the rotational force is input to the drive shaft 250, the drive gear 248 will rotate. The gear 246*a* of the supply roller 56 and the gear of the developing roller 58 (not shown in the drawings) mesh with the drive gear 248. Because of this, when the drive gear 248 rotates, the supply roller 56 and the developing roller 58 will rotate.

When the supply roller 56 rotates, the gear 246*b* will rotate. When the gear 246*b* rotates, the gear 244 of the auger 226 will rotate, and the auger 226 will rotate. When the auger 226 rotates, the toner inside the developing chamber 220 will be transported along the direction S3 of FIG. 10. In other words, toner will be transported from the side wall feed opening 222*a* shown in FIG. 3 in the direction of the side wall return opening 222*b*.

(Construction of the Side Wall Periphery of the Developing Device)

Figure 11:
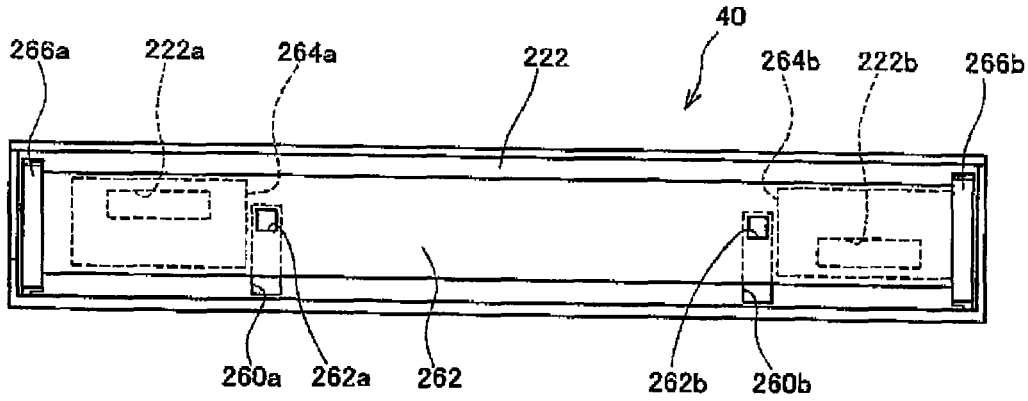
FIG. 11 shows the developing device when viewed along the XI direction of FIG. 3.

FIG. 11 shows a developing device 40 when viewed along the XI direction of FIG. 3. The toner cartridge 42 is not illustrated in FIG. 11.

In the state shown in FIG. 11, the surface of the side wall 222 (the surface on the right side of FIG. 3) is covered by the shutter 262. In his state, the side wall feed opening 222*a* and the second side wall 222*b* are closed by the shutter 262. The shutter 262 is formed along the surface of the side wall 222. In other words, the shutter 262 has an arcuate shape when viewed in cross-section (see FIG. 12).

A guide member 266*a* is fixed to the left end of the shutter 262 (the left end of FIG. 11). A guide member 266*b* is fixed to the right end of the shutter 262. Each guide member 266*a*, 266*b* has an arcuate shape that is identical to the shape of the shutter 262.

Grooves (not shown in the drawings) that guide each guide member 266*a*, 266*b* are formed in the surface of the side wall 222. These grooves extend in the vertical direction in FIG. 11 along the surface of the side wall 222. Each guide member 266*a*, 266*b* are capable of sliding along the grooves in the surface of the side wall 222. In other words, the shutter 262 is capable of sliding along the surface of the side wall 222.

The shutter 266 has a pair of through holes 262*a*, 262*b*. In the state in which the toner cartridge 42 is attached to the developing device, the projection 186*a* (see FIG. 7) will fit into the through hole 262*a*, and the projection 186*b* will fit into the through hole 262*b*. In this state, the projections 186*a*, 186*b* will project through the through holes 262*a*, 262*b*.

A pair of bottomed grooves 260*a*, 260*b* is formed on the side wall 222. The bottomed groove 260*a* guides the projection 186*a* that was fitted into the through hole 262*a*. The bottomed groove 260*b* guides the projection 186*b*.

The side wall feed opening 222*a* and the side wall return opening 222*b* are formed in the side wall 222. In the state shown in FIG. 11, the side wall openings 222*a*, 222*b* are covered by the shutter 262. Because of this, the side wall openings 222*a*, 222*b* are shown with broken lines.

The side wall feed opening 222*a* is located adjacent to the left end of the side wall 222. The side wall return opening 222*b* is located adjacent to the right end of the side wall 222. The side wall feed opening 222*a* is located higher than the side wall return opening 222*b*. The two side wall openings 222*a*, 222*b* have the same shape (a rectangular shape that extends in the horizontal direction).

A pair of sponges 264*a*, 264*b* is interposed between the side wall 222 and the shutter 262. In the state shown in FIG. 11, the sponges 264*a*, 264*b* are concealed by the shutter 262. Because of this, the sponges 264*a*, 264*b* are shown with broken lines. The sponges 264*a*, 264*b* are adhered to the side wall 222, but are not adhered to the shutter 262.

One sponge 264*a* is located around the periphery of the side wall feed opening 222*a*. The sponge 264*a* has an opening 280*a* of the same shape as the side wall feed opening 222*a* (reference number omitted in FIG. 11 but shown in FIGS. 12 and 13). The opening 280*a* of the sponge 264*a* faces the side wall feed opening 222*a*. Because of this, the toner sent from the toner cartridge 42 will pass through both the opening in the sponge 264*a* and the side wall feed opening 222*a*, and arrive at the developing chamber 220.

The other sponge 264*b* is located around the periphery of the side wall return opening 222*b*. Like with the sponge 264*a*, the sponge 264*b* has an opening 280*b* of the same shape as the side wall ret opening 222*b* (shown in FIGS. 12 and 13). The opening 280*b* of the sponge 264*b* faces the side wall return opening 222*b*. The toner of the developing chamber 220 will pass through both the side wall return opening 222*b* and the opening 280*b* of the sponge 264*b*, and will be sent to the toner cartridge 42.

The construction of the developing device 40 and the toner cartridge 42 was described in detail. Next, the operation of the developing device 40 and the toner cartridge 42 will be described in detail.

(Operation of the Developing Device)

The toner cartridge 42 is attached to the developing device 40. In this state, both the toner cartridge 42 and the developing device 40 are pushed toward the photoreceptor 60 (leftward in FIG. 1) by means of the press lock mechanism 209 shown in FIG. 1. In this way, the developing roller 58 can be pressed with respect to the photoreceptor 60.

Figure 12:
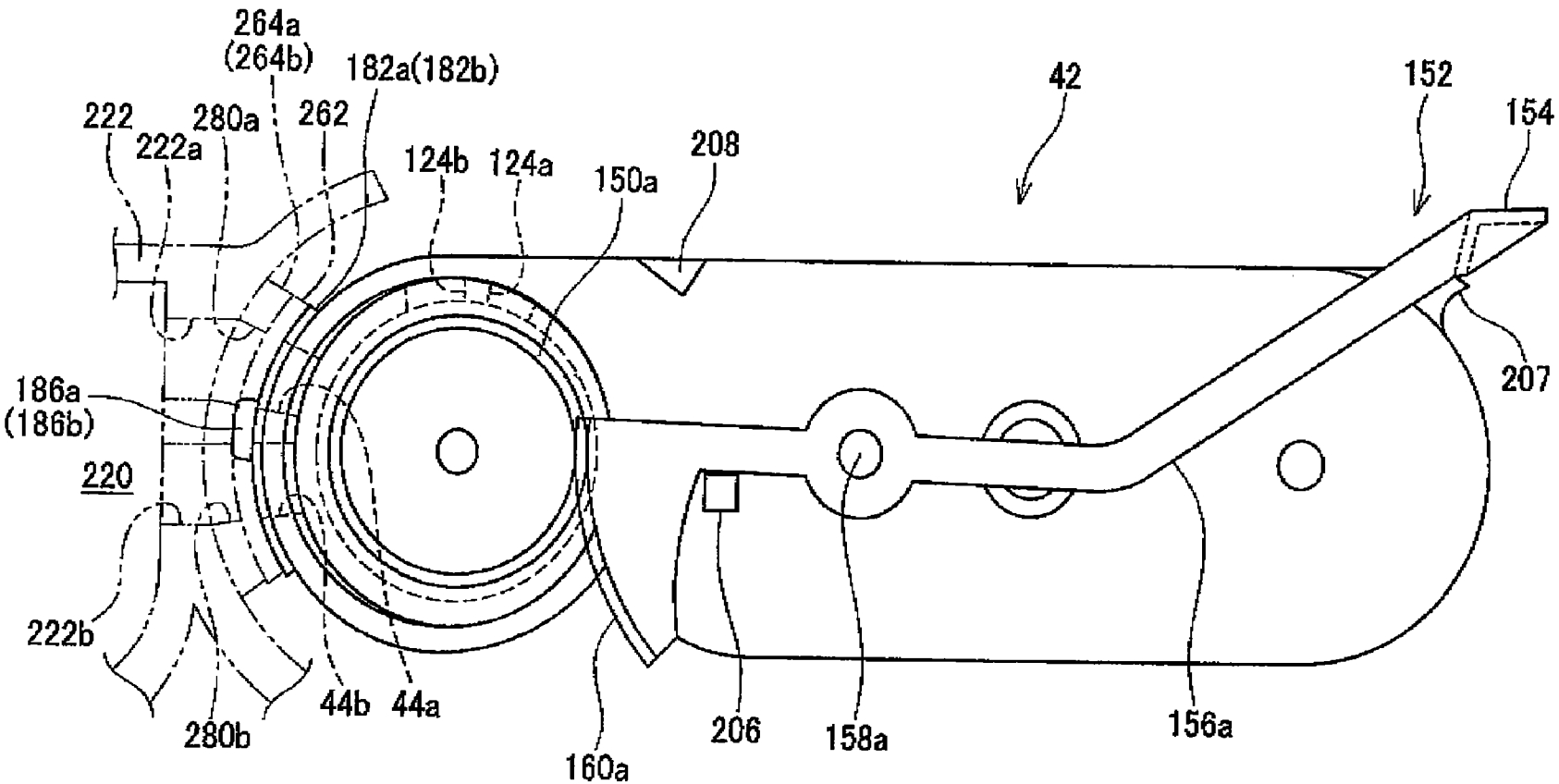
FIG. 12 shows the toner cartridge when viewed along the direction perpendicular to the plane of FIG. 1.

FIG. 12 shows the state immediately after the toner cartridge 42 is attached to the developing device 40. In his state, the rear end of the lever member 152 is held upward. In this state, the lever member 152 is in contact with a downward rotation stop 206 that projects from the side surface of the toner cartridge 42. In this way, the lever member 152 is prevented from rotating past this point in the counterclockwise direction. In addition, in this state, a member 154 on the rear surface side of the lever member 152 rides across a lever lock member 207. The lever member 152 is locked by the lever lock member 207, so that the lever member 152 is not easily rotated in the clockwise direction.

The cylindrical member feed opening 124*a* and the cylindrical member return opening 124*b* of the cylindrical member 124 (see FIG. 3 etc.) are in locations that do not face the case feed opening 44*a* and the case return opening 44*b*. In other words, in this state, the case feed opening 44*a* and the case return opening 44*b* are closed by the cylindrical member 124. In addition, in this state, the cylindrical member opening 124*c* (see FIG. 3) is placed in a location such that the chamber 110 and the chamber 112 do not communicate.

In the state shown in FIG. 12, the projections 186*a*, 186*b* of the cylindrical member 124 (see FIG. 7) fit into the through holes 262*a*, 262*b* of the shutter 262 (see FIG. 11).

A user can push down on the rear end of the lever member 152 from the state shown in FIG. 12. If the rear end of the lever end 152 is pushed downward, the lever member 152 will pivot around the pivot shaft 158*a* in the clockwise direction. If the lever member 152 is pivoted in the clockwise direction, it will come into contact with an upward rotation stop 208 that projects out from the side surface of the toner cartridge 42. In this way, the lever member 152 is prevented from rotating past this point in the clockwise direction.

The rotational force of the lever member 152 is transmitted to the cylindrical member 124 via the gear 160*a* (160*b*) and the gear 150*a* (150*b*). In this way, the cylindrical member 124 will rotate in the counterclockwise direction.

Figure 13:
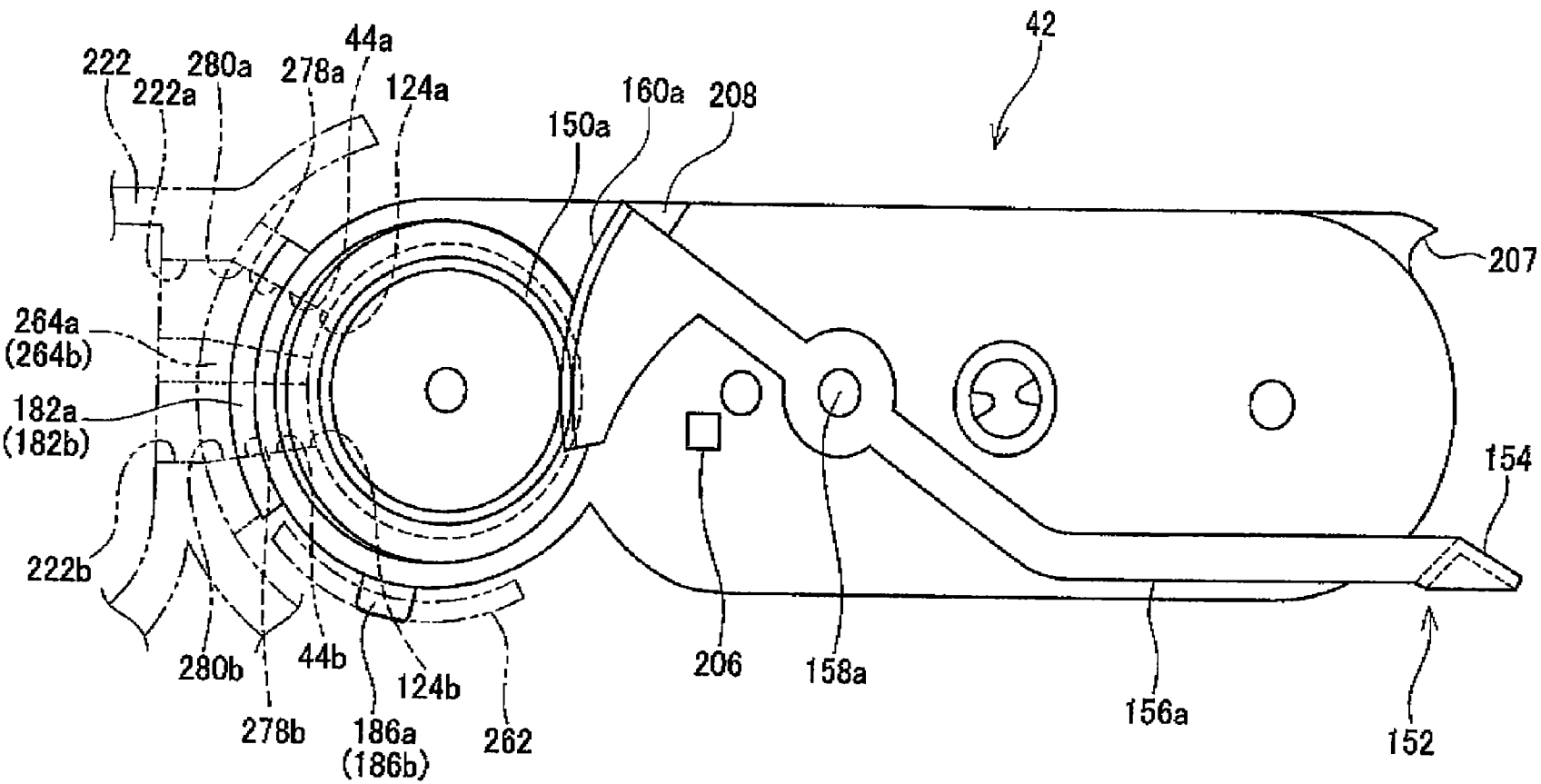
FIG. 13 shows the toner cartridge when viewed along the direction perpendicular to the plane of FIG. 1.

FIG. 13 shows a state in which the rear end of the lever member 152 is pushed downward. In this state, the cylindrical member feed opening 124*a* faces the case feed opening 44*a*, and the cylindrical member return opening 124*b* faces the case return opening 44*b*. This is clearly shown in FIG. 13.

In addition, in this state, the cylindrical member opening 124*c* (see FIG. 3) is placed in a location such that the chamber 110 and the chamber 112 communicate.

When the cylindrical member 124 rotates, the projections 186*a*, 186*b* of the cylindrical member 124 will also rotate together therewith. Since the projections 186*a*, 186*b* fit into the through holes 262*a*, 262*b* of the shutter 262, when the cylindrical member 124 rotates, the shutter 262 will slide with respect to the side wall 222. In the state shown in FIG. 13, the shutter 262 will be located further downward than the state shown in FIG. 12. In this way, the side wall feed opening 222*a* and the side wall return opening 222*b* will be open.

When the shutter 262 slides downward, the sponges 182*a*, 182*b* on the toner cartridge 42 side will expand, and the sponges 264*a*, 264*b* on the developing device 40 side will expand. In this way, the sponge 182*a* and the sponge 264*a* will contact with each other, and the sponge 182*b* and the sponge 264*b* will contact with each other.

In the state shown in FIG. 13, the cylindrical member feed opening 124*a*, the case feed opening 44*a*, the opening 278*a* of the sponge 182*a*, the opening 280*a* of the sponge 264*a*, and the side wall feed opening 222*a* communicate with each other. Because of this, the toner of the tone cartridge 42 can be sent to the developing chamber 220.

In addition, in the state shown in FIG. 13, the cylindrical member return opening 124*b*, the case return opening 44*b*, the opening 278*b* of the sponge 182*b*, the opening 280*b* of the sponge 264*b*, and the side wall return opening 222*b* communicate with each other. Because of this, the toner in the developing chamber 220 can return to the toner cartridge 42.

When in the state shown in FIG. 13, each agitator 116, 118, 120, 126 (see FIG. 3 etc.) will rotate. In addition, the supply roller 56, the developing roller 58, and the auger 226 (see FIG. 3 etc.) will rotate.

The toner inside the chamber 112 will be transported from the case return opening 44*b* to the case feed opening 44*a* by means of the transport portion 190 of the agitator 126 (see FIG. 4 etc.). In addition, the toner near the case feed opening 44*a* will be sent toward the case feed opening 44*a* by means of the dispatch portion 192 of the agitator 126. In this way, the toner of the toner cartridge 42 will be sent to the developing chamber 220 via the cylindrical member feed opening 124*a*, the case feed opening 44*a*, the opening 278*a* of the sponge 182*a*, the opening 280*a* of the sponge 264*a*, and the side wall feed opening 222*a*.

The developing chamber 220 is filled with toner. The anger 226 will transport the toner inside the developing chamber 220 from the side wall feed opening 222*a* to the side wall return opening 222*b* along the supply roller 56. The toner around the periphery of the side wall return opening 222*b* will be pushed in the direction of the side wall return opening 222*b*. In this way, the toner of the developing chamber 220 will return to the chamber 112 of the toner cartridge 42 via the side wall return opening 222*b*, the opening 280*b* of the sponge 264*b*, the opening 278*b* of the sponge 182*b*, the case return opening 44*b*, and the cylindrical member return opening 124*b*.

As is clear from the aforementioned description, with the configuration of the present embodiment, toner will circulate between the developing device 40 and the toner cartridge 42.

On the other hand, the supply roller 56 will support toner inside the developing chamber 220. Toner will be supplied from the supply roller 56 to the developing roller 5S by rotating the developing roller 58 while in contact with the supply roller 56. At this point, the toner will have a positive static charge due to the friction between the supply roller 56 and the developing roller 58. The developing roller 58 supports toner having a positive electrostatic charge.

The toner on the developing roller 58 will be supplied to the photoreceptor 60 (see FIG. 1). In this way, an electrostatic latent image on the photoreceptor 60 will be visible, and the photoreceptor 60 will be developed. The visible image on the photoreceptor 60 will be transferred to the print medium.

The construction of the printer 10 of the present embodiment was described in detail. According to the present embodiment, toner will circulate between the toner cartridge 42 and the developing device 40 while developing the photoreceptor 60. Because of this, toner that has deteriorated in quality will be mixed together with new toner. Toner that is a uniform mixture of new toner and toner that has deteriorated in quality will be adhered to the supply roller 56. Because a uniform mixture of this toner is used for development, the entire surface of the photoreceptor 60 can be developed with toner having a uniform electrostatic charge.

The side wall feed opening 222*a* is located higher than the side wall return opening 222*b*. Toner can be sent into the developing chamber 220 from a high position. The toner density inside the developing chamber 220 can be increased. Because the toner density adjacent to the supply roller 56 is high, toner can be uniformly supplied to the supply roller 56 at a suitable thickness. This contributes to the toner being uniformly adhered to the developing roller 58 at a suitable thickness.

In addition, because the side wall return opening 222*b* is located lower, the toner can be sent from a low position of the developing chamber 220 to the toner cartridge 42. The toner of the developing chamber 220 can be smoothly sent. According to the present embodiment, the toner can be smoothly circulated.

In addition, the auger 226 is located lower than the side wall feed opening 222*a*, and higher than the side wall return opening 222*b*. According to this construction, toner sent from the side wall feed opening 222*a* can be transported with good efficiency to the second side wall 222*b*. When the technology of the present embodiment is used, toner will circulate smoothly.

Second Embodiment

Figure 14:
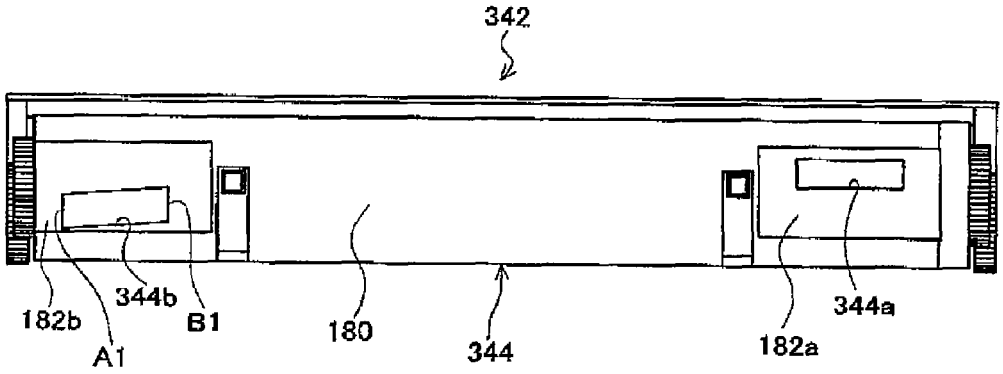
FIG. 14 shows a toner cartridge of a second embodiment.

Here, the points that differ from the first embodiment will be described. FIG. 14 shows a front view of a toner cartridge 342 of the present embodiment (the same view as shown in FIG. 7 of the first embodiment).

Like with the first embodiment, a pair of case openings 344*a*, 344*b* is formed in a front surface 180 of a case main body 344. The case feed opening 344*a* is constructed in the same way as in the first embodiment. The case return opening 344*b* is inclined downward and to the left. In other words, the end portion A1 on the far side from the case feed opening 344*a* is located below the end portion B1 on the near side to the case feed opening 344*a*.

The sponge 182*b* located around the case return opening 344*b* has an opening that is the same shape as the case return opening 344*b* (reference number omitted). The opening of the sponge 182*b* faces the case return opening 344*b*.

Figure 15:
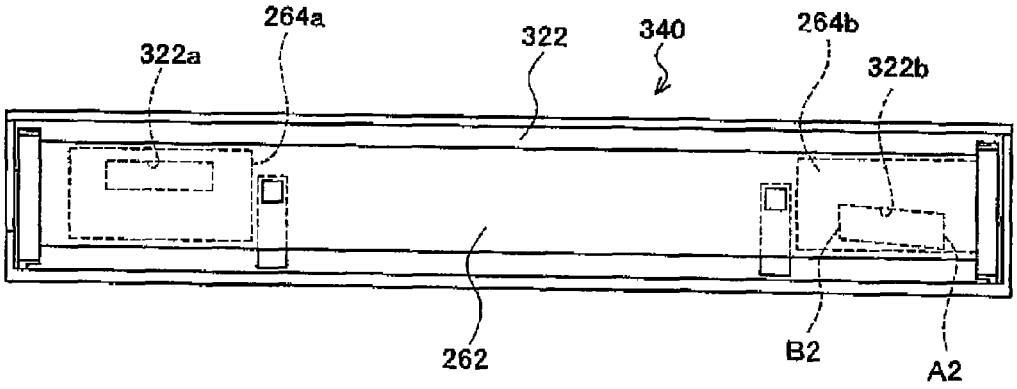
FIG. 15 shows a developing device of the second embodiment.

FIG. 15 shows a front view of a developing device 340 of the present embodiment (the same view as shown in FIG. 11 of the first embodiment). Like with the first embodiment, a pair of side wall opening 322*a*, 322*b* is formed in the side wall 322 of the developing device 340. The side wall feed opening 322*a* is constructed in the same way as in the first embodiment. The side wall return opening 322*b* is inclined downward and to the right. In other words, the end portion A2 on the far side from the side wall feed opening 322*a* is located below the end portion B2 on the near side to the side wall feed opening 322*a*. The side wall return opening 322*b* has the same shape as the case return opening 344*b*. The sponge 264*b* located around the side wall return opening 322*b* has an opening that is the same shape as the side wall return opening 322*b* (reference number omitted). The opening of the sponge 264*b* faces the side wall return opening 322*b*.

When the toner cartridge 342 is attached to the developing device 340, the case feed opening 344*a* and the side wall feed opening 322*a* face each other. In addition, the case return opening 344*b* and the side wall return opening 322*b* face each other.

In the present embodiment, because the case return opening 344*b* and the side wall return opening 322*b* are inclined, the toner inside the developing chamber 220 can be sent to the toner cartridge 342 smoothly.

Third Embodiment

Figure 16:
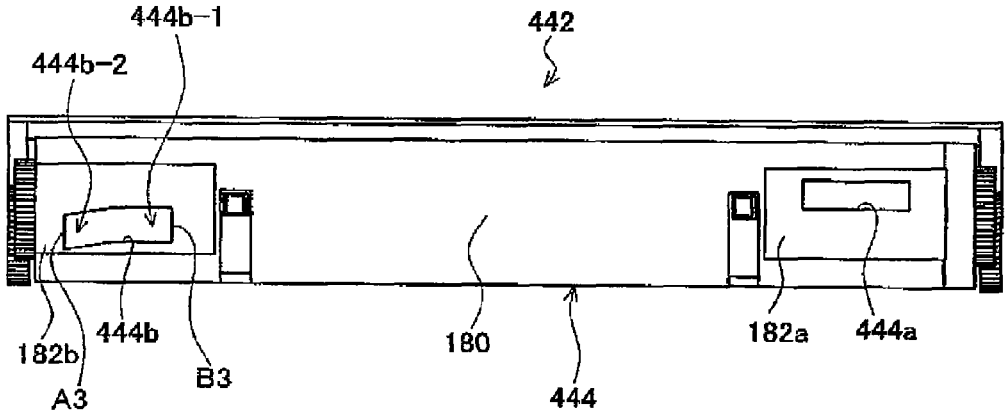
FIG. 16 shows a toner cartridge of a third embodiment.

FIG. 16 shows a front view of a toner cartridge 442 of the present embodiment (the same view as shown in FIG. 7 of the first embodiment).

With a case ret opening 444*b* formed in the front surface 180 of a case main body 444, the right half 444*b*-1 extends along the horizontal direction, and the left half 444*b*-2 is inclined downward and to the left. In this case as well, the case return opening 444*b* can be said to be inclined downward and to the left. The end portion A3 on the far side from a case feed opening 444*a* is located below the end portion B3 on the near side to the case feed opening 444*a*.

Figure 17:
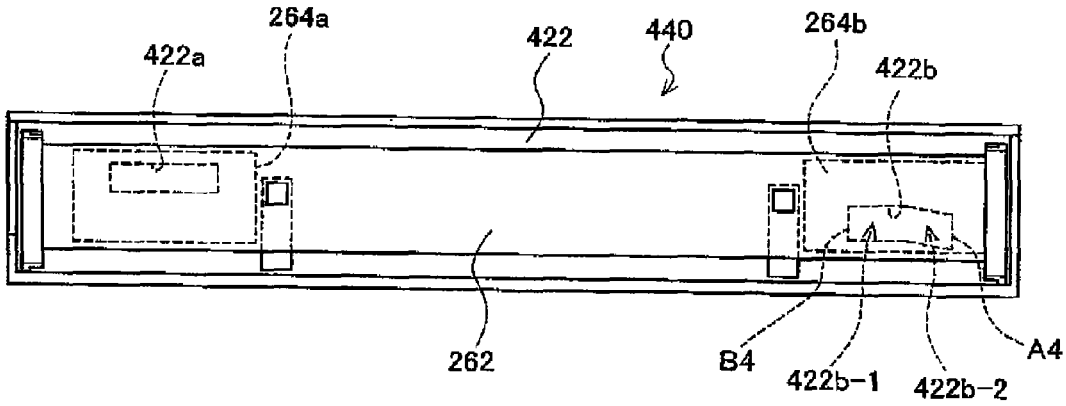
FIG. 17 shows a developing device of the third embodiment.

FIG. 17 shows a front view of a developing device 440 of the present embodiment (the same view as shown in FIG. 11 of the first embodiment).

With a side wall return opening 422*b* formed in a side wall 422, the left half 422*b*-1 extends along the horizontal direction, and the right half 422*b*-2 is inclined downward and to the right. In this case as well, the side wall return opening 422*b* can be said to be inclined downward and to the right. The end portion A4 on the far side from a side wall feed opening 422*a* is located below the end portion B4 on the near side to the side wall feed opening 422*a*. The side wall return opening 422*b* has the same shape as the case return opening 444*b*.

When the toner cartridge 442 is attached to the developing device 440, the case feed opening 444*a* and the side wall feed opening 422*a* face each other. In addition, the case return opening 444*b* and the side wall return opening 422*b* face each other.

Even if the case return opening 444*b* and the side wall return opening 422*b* are constructed like in the present embodiment, the toner inside the developing chamber 220 can be sent to the toner cartridge 442 smoothly.

Fourth Embodiment

Figure 18:
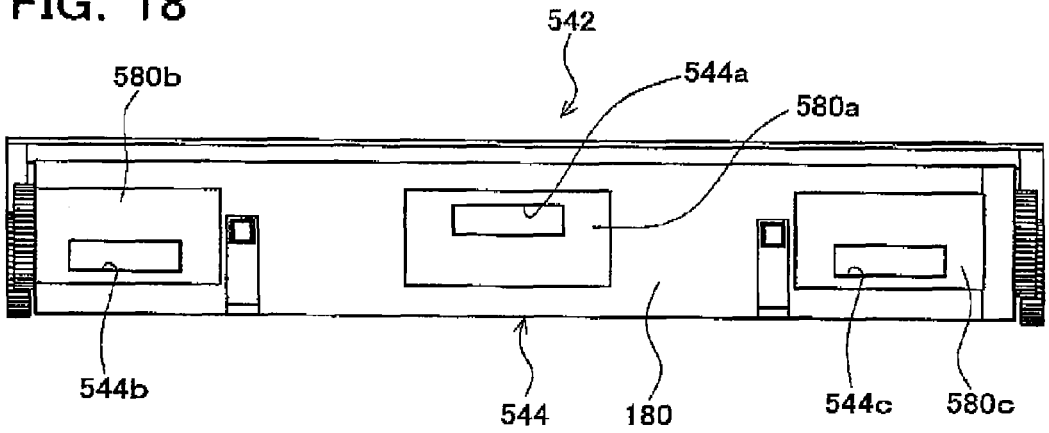
FIG. 18 shows a toner cartridge of a fourth embodiment.

Here, the points that differ from the first embodiment will be described. FIG. 18 shows a front view of a toner cartridge 542 of the present embodiment (the same view as shown in FIG. 7 of the first embodiment).

Three openings 544*a*, 544*b*, and 544*c* are formed in the front surface 180 of a case main body 544. The three openings 544*a*, 544*b*, 544*c* have the same shape (a rectangular shape in the horizontal direction of FIG. 18).

The case feed opening 544*a* is located between the case return openings 544*b*, 544*c* in the horizontal direction of FIG. 18. In the horizontal direction, the distance between the case feed opening 544*a* and the case return opening 544*b* is equal to the distance between the case feed opening 544*a* and the case return opening 544*c*. The case feed opening 544*a* is located higher than both the case return opening 544*b* and the case return opening 544*c*. The case return openings 544*b*, 544*c* are located at the same height.

Toner sent to the outside from the case main body 544 passes through the case feed opening 544*a*. Toner returning to the case main body 544 from a developing device 540 (see FIG. 20) will pass through the case return openings 544*b*, 544*c*.

A sponge 580*a* located around the case feed opening 544*a* has an opening that is the same shape as the case feed opening 544*a* (reference number omitted). The opening of the sponge 580*a* faces the case feed opening 544*a*.

Likewise, a sponge 580*b* located around the case return opening 544*b* has an opening that is the same shape as the case return opening 544*b* (reference number omitted). The opening of the sponge 580*b* faces the case return opening 544*b*.

In addition, a sponge 580*c* located around the case return opening 544*c* has an opening that is the same shape as the case return opening 544*c* (reference number omitted). The opening of the sponge 580*c* faces the case return opening 544*c*.

Figure 19:
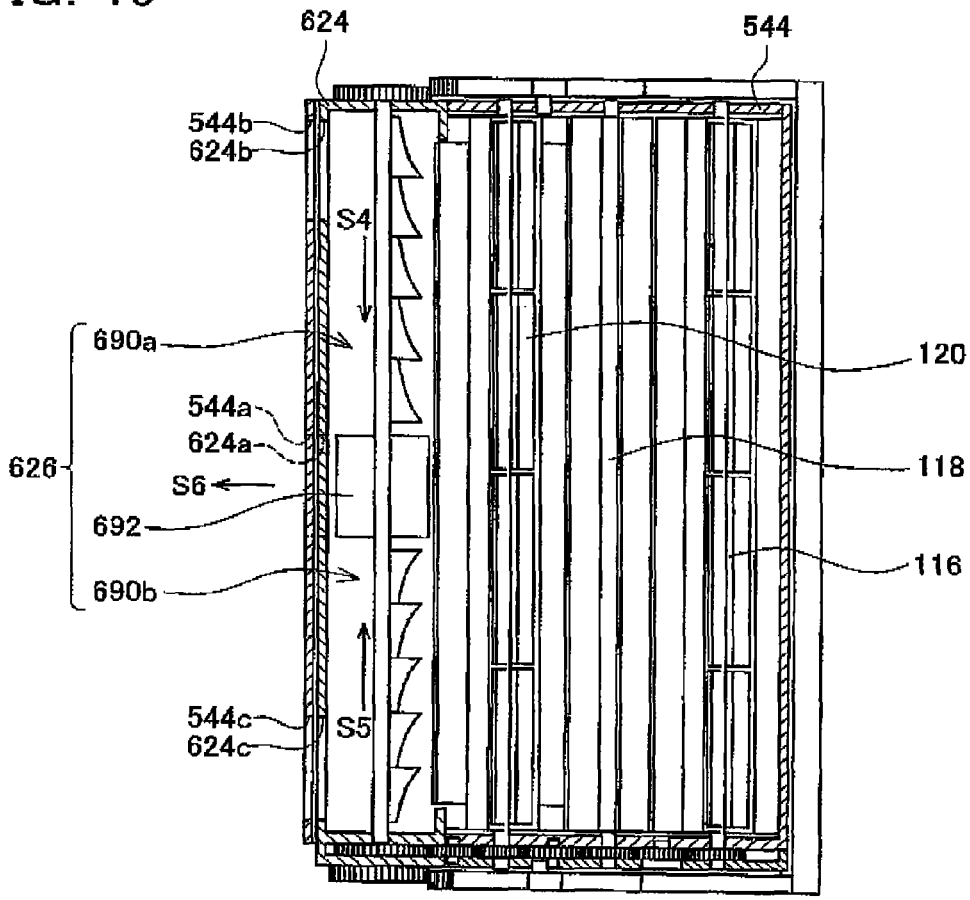
FIG. 19 shows a horizontal cross-section of the toner cartridge of the fourth embodiment.

FIG. 19 shows a horizontal cross-section of the toner cartridge 542 of the present embodiment (the same view as shown in FIG. 4 of the first embodiment).

The cylindrical member 624 of the present embodiment has a cylindrical member feed opening 624*a* that faces the case feed opening 544*a*. In addition, the cylindrical member 624 has a cylindrical member return opening 624*b* that faces the case return opening 544*b*, and a cylindrical member return opening 624*c* that faces the case return opening 544*c*. The other construction of the cylindrical member 624 is identical to the cylindrical member 124 of the first embodiment.

The three agitators 116, 118, 120 on the right side are constructed to be identical to those of the first embodiment. The agitator 626 that is furthest to the left has a first transport portion 690*a*, a second transport portion 690*b*, and a dispatch portion 692. The first transport portion 690*a* is located above the dispatch portion 692 (upward in FIG. 19). The second transport portion 690*b* is located below the dispatch portion 692 (downward in FIG. 19). The first transport portion 690*a* and the second transport portion 690*b* are constructed to be vertically symmetrical. In other words, the first transport portion 690*a* transports toner in the direction of arrow S4, and the second transport portion 690*b* transports toner in the direction of arrow S5. The dispatch portion 692 sends out toner that was transported in the direction of arrows S4 and S5 in the direction of arrow S6.

Figure 20:
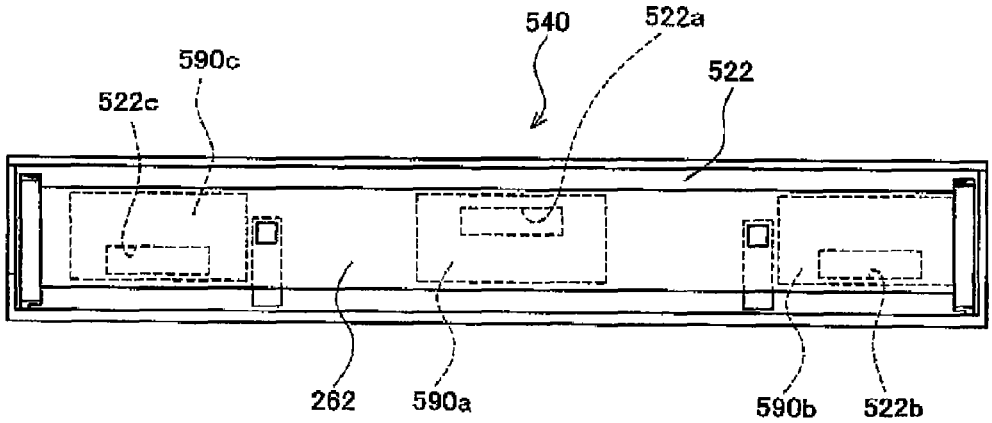
FIG. 20 shows a developing device of the fourth embodiment.

FIG. 20 shows a front view of the developing device 540 of the present embodiment (the same view as shown in FIG. 11 of the first embodiment).

The three openings 522*a*, 522*b*, 522*c* are formed in the side wall 522. The three openings 522*a*, 522*b*, 522*c* have the same shape as the case openings 544*a* etc.

The side wall feed opening 522*a* is located between the side wall return opening 522*b* and the side wall opening 522*c* in the horizontal direction of FIG. 20. In the horizontal direction, the distance between the side wall feed opening 522*a* and the side wall return opening 522*b* is equal to the distance between the side wall feed opening 522*a* and the side wall return opening 522*c*. The side wall feed opening 522*a* is located higher than both the side wall return opening 522*b* and the side wall return opening 522*c*. The side wall return opening 522*b* and the side wall return opening 522*c* are located at the same height.

Toner sent from the case main body 544 will pass through the side wall feed opening 522*a*. Toner returning to the toner cartridge 542 from the developing chamber 220 (see FIG. 3 etc.) will pass through the side wall return opening 522*b* and the side wall return opening 522*c*.

A sponge 590*a* located around the side wall feed opening 522*a* has an opening that is the same shape as the side wall feed opening 522*a* (reference number omitted). The opening of the sponge 590*a* faces the side wall feed opening 522*a*.

Likewise, a sponge 590*b* located around the side wall return opening 522*b* has an opening that is the same shape as the side wall return opening 522*b* (reference number omitted). The opening of the sponge 590*b* faces the side wall return opening 522*b*.

In addition, a sponge 590*c* located around the side wall return opening 522*c* has an opening that is the same shape as the side wall return opening 522*c* (reference number omitted). The opening of the sponge 590*c* faces the side wall return opening 522*c*.

Figure 21:
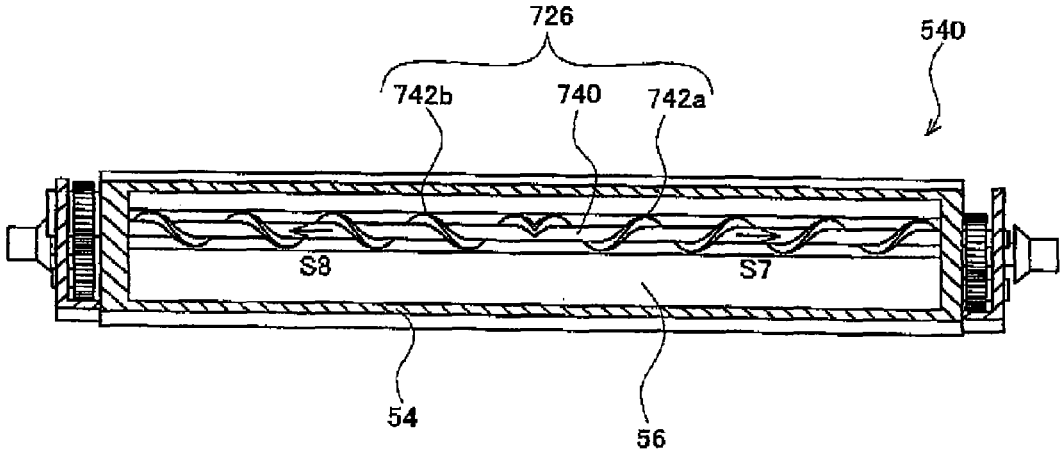
FIG. 21 shows a vertical cross-section of the developing device of the fourth embodiment.

FIG. 21 shows a vertical cross-section of the developing device 540 of the present embodiment (a view corresponding to FIG. 10 of the first embodiment). In FIG. 21, the case 54 and the supply roller 56 employ the same reference numbers as the first embodiment.

The auger 726 has a rotational shaft 740 and spiral members 742*a*, 742*b*. One spiral member 742*a* is formed on the right half of the rotational shaft 740. The other spiral member 742*b* is formed on the left half of the rotational shaft 740. The spiral member 742*a* and the spiral member 742*b* are formed to be horizontally symmetrical. In other words, when the auger 726 rotates, the right side of the anger 726 will transport toner in the direction of arrow S7, and the left half of the auger 726 will transport toner in the direction of arrow S8. The auger 726 will transport toner from the center thereof to both ends thereof. In other words, the auger 726 will transport toner from the first side wall 522*a* to the side wall return opening 522*b* and the side wall return opening 522*c*.

When the toner cartridge 542 is attached to the developing device 540, the case feed opening 544*a* and the side wall feed opening 522*a* face each other. In addition, the case return opening 544*b* and the side wall return opening 522*b* face each other, and the case return opening 544*c* and the side wall return opening 522*c* face each other.

Toner sent in the direction of arrow S6 in FIG. 19 will arrive at the developing chamber 220 via the cylindrical member feed opening 624*a*, the case feed opening 544*a*, the opening of the sponge 580*a* (reference number omitted), the opening of the sponge 590*a* (reference number omitted), and the side wall feed opening 522*a*.

Toner inside the developing chamber 220 will be transported by the auger 726. Toner will be transported from the side wall feed opening 522*a* to the side wall return opening 522*b*, and toner will be transported from the side wall feed opening 522*a* to the side wall return opening 522*c*.

The toner near the side wall return opening 522*b* inside the developing chamber 220 will arrive in the toner cartridge 542 via the side wall return opening 522*b*, the opening of the sponge 590*b* (reference number omitted), the opening of the sponge 580*b* (reference number omitted), the case return opening 544*b*, and the cylindrical member return opening 624*b*. In addition, the toner near the side wall return opening 522*c* inside the developing chamber 220 will arrive in the toner cartridge 542 via the side wall return opening 522*c*, the opening of the sponge 590*c* (reference number omitted), the opening of the sponge 580*c* (reference number omitted), the case return opening 544*c*, and the cylindrical member return opening 624*c*.

The returned toner will be transported by the auger 626. Toner will be transported from the case return opening 544*b* to the case feed opening 544*a*, and toner will be transported from the case return opening 544*c* to the case feed opening 544*a*.

According to the present embodiment, toner can be circulated between the toner cartridge 542 and the developing device 540 during development.

According to this embodiment, toner can be circulated more smoothly because there are two pathways that return the toner from the developing device 540 to the toner cartridge 542.

Specific examples of the present invention have been described in detail above, but these are simply illustrations, and do not limit the scope of the claims. In the technology disclosed within the scope of the claims, the specific examples illustrated above can be modified and changed in various ways. Modifications of the embodiments will be illustrated below.

(1) For example, in the second embodiment, the end portion B1 of the case return opening 344*b* (see FIG. 14) may be located at the same height as the case feed opening 344*a*. The end portion A1 of the case return opening 344*b* is lower than the end portion B1. In this construction, the case feed opening 344*a* can be said to be located higher than the case return opening 344*b*.

In this modification, the end portion B2 of the side wall feed opening 322*b* (see FIG. 15) may be located at the same height as the side wall feed opening 322*a*. The end portion A2 of the side wall return opening 344*b* is lower than the end portion B2. In this case, the side wall feed opening 322*a* can be said to be located higher than the side wall return opening 322*b*.

(2) In each of the aforementioned embodiments, the case feed opening and the case return opening may have different sizes. In addition, the side wall feed opening and the side wall return opening may have different sizes.

In particular, in the fourth embodiment, the size of the case feed opening 544*a* (the size when viewed in a direction perpendicular to the plane of FIG. 18) may be larger than the case return opening 544*b* (or the case return opening 544*c*). Also, the size of the side wall feed opening 522*a* (the size when viewed in the direction perpendicular to the plane of FIG. 20) may be larger than the side wall return opening 522*b* (or the side wall return opening 522*c*).

(3) In each of the aforementioned embodiments, the developing device and the toner cartridge are constructed separately, but a developing device having a toner cartridge built therein may be adopted. In this case, the toner chamber may be detachable from other portions, and the toner chamber may not be detachable from the other portions.

For example, the toner cartridge 42 of the first embodiment may be fixed to the developing device 40 rather than being detachable from the developing device 40. In this case, the developing device 40 and the toner cartridge 42 fixed thereto can be collected referred to as a "developing device".

In this modification, the toner cartridge 42 and the case 54 can be constructed as an integral case. In this case, the side wall 222 will become a wall that divides the chamber 46 inside the toner cartridge 42 from the developing chamber 220. In this modification, a hole for replenishing toner is preferably provided in the toner cartridge 42.

(4) In the aforementioned embodiments, the supply roller 56 is provided. However, a construction can be adopted in which the supply roller 56 is not provided. In this case, toner will be directly supplied from the developing chamber 220 to the developing roller 58.

(5) In the aforementioned embodiments, the developing chamber 220 is defined by the developing roller 58. However, a construction can also be adopted in which the supply roller 56 defines the developing chamber, rather than the developing roller 58 defining the developing chamber. In addition, a construction can also be adopted in which both the supply roller 56 and the developing roller 58 define the developing chamber.

In addition, the technological elements described in the present specification or drawings exhibit technical utility either individually or in various combinations, and are not limited to the combinations disclosed in the claims at the time of application. Furthermore, the technology illustrated in the present specification or drawings simultaneously achieve a plurality of objects, and has technical utility by achieving one of these objects.

What is claimed is:

1. A developing device to which a toner cartridge is to be attached, the developing device comprising:

a developing roller comprising a rotational axis extending along a horizontal direction, the developing roller being capable of supporting a toner;

a casing comprising a developing chamber for accommodating the toner to be supported by the developing roller, a feed opening for feeding the toner from the toner cartridge to the developing chamber, and a return opening for returning the toner from the developing chamber to the toner cartridge, wherein the developing chamber is defined by the developing roller; and a transporting member located within the developing chamber, wherein the transporting member transports the toner within the developing chamber from the feed opening to the return opening, wherein the feed opening and the return opening are offset along the horizontal direction, and the feed opening is located higher than the return opening, and the developing device is configured to accept the toner cartridge in a detachable manner.

2. The developing device as in claim 1, further comprising:

a supply roller located within the developing chamber, the supply roller comprising a rotational axis extending along the direction in which the rotational axis of the developing roller extends, the supply roller being capable of supplying the toner within the developing chamber to the developing roller, wherein the feed opening is located higher than the supply roller.

3. The developing device as in claim 1, wherein the transporting member comprises a rotational axis extending along the direction in which the rotational axis of the developing roller extends, and the transporting member transports the toner by rotating.

4. The developing device as in claim 3, wherein the transporting member comprises a spiral member formed in a spiral manner along the rotational axis of the transporting member.

5. The developing device as in claim 3, wherein the transporting member is located lower than the feed opening, and the transporting member is located higher than the return opening.

6. The developing device as in claim 1, wherein a first end of the return opening is located lower than a second end of the return opening, and the first end is far from the feed opening, and the second end is close to the feed opening.

7. The developing device as in claim 1, wherein the casing further comprises a side wall defining the developing chamber, and a device side shutter, the feed opening and the return opening are formed in the side wall, in a front view of the side wall, the feed opening is located at a position which is adjacent to one end of the side wall along the horizontal direction, and the return opening is located at a position which is adjacent to the other end of the side wall along the horizontal direction, the side wall divides the inside of the developing device and the outside of the developing device, and the device side shutter opens and closes the feed opening and the return opening.

8. The developing device as in claim 1, wherein the casing further comprises two return openings, and the feed opening is located between the return openings along the horizontal direction.

9. A toner cartridge for providing a toner to a developing device, comprising:

a casing comprising a toner chamber for accommodating a toner, a feed opening for feeding a toner from the toner chamber to the outside of the casing, and a return opening for returning the toner from the outside of the casing to the toner chamber; and a transporting member that transports the toner within the toner chamber from the return opening to the feed opening, wherein the feed opening and the return opening are offset along a horizontal direction, the feed opening is located higher than the return opening, and the toner cartridge is configured to attach to the developing device in a detachable manner.

10. The toner cartridge as in claim 9, wherein a first end of the return opening is located lower than a second end of the return opening, and the first end is far from the feed opening, and the second end is close to the feed opening.

11. The toner cartridge as in claim 9, further comprising:

a cartridge side shutter that opens and closes the feed opening and the return opening.

12. The toner cartridge as in claim 9, wherein the casing has a substantially rectangular parallelepipedic shape, and the feed opening and the return opening are formed in one predetermined side surface of the casing.

13. The toner cartridge as in claim 12, wherein the feed opening is located at a position that is adjacent to one end of the predetermined side surface along the horizontal direction, and the return opening is located at a position that is adjacent to the other end of the predetermined side surface along the horizontal direction.

14. The toner cartridge as in claim 9, wherein the casing comprises two return openings, and the feed opening is located between the return openings along the horizontal direction.

15. The toner cartridge as in claim 9, wherein the toner is non-magnetic one component toner.

* * * * *